US009031265B2

(12) United States Patent
Fukushima et al.

(10) Patent No.: US 9,031,265 B2
(45) Date of Patent: May 12, 2015

(54) PIEZOELECTRIC SPEAKER, PIEZOELECTRIC AUDIO DEVICE EMPLOYING PIEZOELECTRIC SPEAKER, AND SENSOR WITH ALERT DEVICE ATTACHED

(75) Inventors: Minoru Fukushima, Osaka (JP); Kosaku Kitada, Osaka (JP); Osamu Akasaka, Osaka (JP); Akihiro Nishikawa, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 944 days.

(21) Appl. No.: 13/142,003

(22) PCT Filed: Dec. 25, 2009

(86) PCT No.: PCT/JP2009/071550

§ 371 (c)(1),
(2), (4) Date: Jun. 24, 2011

(87) PCT Pub. No.: WO2010/074206

PCT Pub. Date: Jul. 1, 2010

(65) Prior Publication Data

US 2011/0255718 A1 Oct. 20, 2011

(30) Foreign Application Priority Data

| | | |
|---|---|---|
| Dec. 26, 2008 | (JP) | 2008-334854 |
| Dec. 26, 2008 | (JP) | 2008-334872 |
| Oct. 27, 2009 | (JP) | 2009-246392 |

(51) Int. Cl.
*H04R 25/00* (2006.01)
*H04R 3/00* (2006.01)

(Continued)

(52) U.S. Cl.
CPC ..... *H04R 17/00* (2013.01); *H04R 1/345* (2013.01); *H04R 7/04* (2013.01); *H04R 7/20* (2013.01); *H04R 2231/003* (2013.01); *H04R 17/10* (2013.01); *H04R 2307/207* (2013.01)

(58) Field of Classification Search
CPC ..... H04R 17/00; H04R 17/10; H04R 1/345; H04R 2231/003; H04R 2307/207; H04R 7/04; H04R 7/20
USPC ..... 381/152, 190, 150, 423, 426
See application file for complete search history.

(56) References Cited

U.S. PATENT DOCUMENTS

| | | | | |
|---|---|---|---|---|
| 1,891,566 | A | 12/1932 | McKellip | |
| 4,386,241 | A * | 5/1983 | Maeda | 381/190 |

(Continued)

FOREIGN PATENT DOCUMENTS

| | | |
|---|---|---|
| CN | 85108268 | 6/1987 |
| CN | 1443021 | 9/2003 |

(Continued)

OTHER PUBLICATIONS

Search report from E.P.O., mail date is Jul. 29, 2013.

(Continued)

*Primary Examiner* — Fan Tsang
*Assistant Examiner* — Eugene Zhao
(74) *Attorney, Agent, or Firm* — Greenblum & Bernstein, P.L.C.

(57) ABSTRACT

A piezoelectric speaker includes: a piezoelectric vibrator including a piezoelectric body formed of a piezoelectric element and a plate-shaped body which has a larger diameter than the piezoelectric body and which is attached to a surface of the piezoelectric body in a concentric form; and a film-shaped body that is provided around the piezoelectric vibrator so as to elastically hold the piezoelectric vibrator. The film-shaped body includes a coarse and dense portion in a circumferential direction thereof, which has a physically coarse portion which can become a mountain portion or a valley portion or both, and which is disposed so as to correspond to a natural frequency of an in-phase mode in which antinodes and nodes are formed in a concentric form. The piezoelectric vibrator and the film-shaped body form a sound producing body.

10 Claims, 22 Drawing Sheets

(51) Int. Cl.

| | |
|---|---|
| ***H04R 17/00*** | (2006.01) |
| ***H04R 17/10*** | (2006.01) |
| *H04R 1/34* | (2006.01) |
| *H04R 7/04* | (2006.01) |
| *H04R 7/20* | (2006.01) |

(56) References Cited

U.S. PATENT DOCUMENTS

| | | | | |
|---|---|---|---|---|
| 4,449,019 | A * | 5/1984 | Kakehi et al. | 381/345 |
| 4,654,554 | A * | 3/1987 | Kishi | 381/190 |
| 6,522,759 | B1 | 2/2003 | Mori | |
| 2002/0186860 | A1 * | 12/2002 | Ogura et al. | 381/398 |
| 2003/0165249 | A1 | 9/2003 | Higuchi | |

FOREIGN PATENT DOCUMENTS

| | | |
|---|---|---|
| JP | 57-010196 | 1/1982 |
| JP | 57-83998 | 5/1982 |
| JP | 58-54200 | 4/1983 |
| JP | 59-65000 | 4/1984 |
| JP | 61-60594 | 4/1986 |
| JP | 62-125095 | 8/1987 |
| JP | 63-102599 | 5/1988 |
| JP | 3-022796 | 1/1991 |
| JP | 5-122793 | 5/1993 |
| JP | 5-70094 | 9/1993 |
| JP | 6-38400 | 5/1994 |
| JP | 8-331690 | 12/1996 |
| JP | 9-271096 | 10/1997 |
| JP | 10-126885 | 5/1998 |
| JP | 11-196494 | 7/1999 |
| JP | 2001-339791 | 12/2001 |
| JP | 2004-88733 | 3/2004 |
| JP | 2005-277616 | 10/2005 |
| JP | 3970360 | 6/2007 |
| JP | 2007-264996 | 10/2007 |

OTHER PUBLICATIONS

K. Tani, "Piezoelectric Ceramic Buzzers Achieve High Sound Levels", Matsushita Electronic Components Co., Ltd., 2209 Journal of Electronic Engineering (JEE), Dempa Publications Inc., vol. 17, No. 157, (Jan. 1, 1980), Tokyo, JP, XP-000795324.

* cited by examiner

| | | L: LENGTH | D: CROSS-SECTIONAL AREA |
|---|---|---|---|
| ..... | : A WITH DUCT | 20.5mm | 4mm × 25.5mm |
| ——— | : B WITH DUCT | 20.5mm | 4mm × 15mm |
| - - - - - | : C WITH DUCT | 20.5mm | 4mm × 9mm |
| ——— | : D WITHOUT DUCT | | |

PIEZOELECTRIC SPEAKER, PIEZOELECTRIC AUDIO DEVICE EMPLOYING PIEZOELECTRIC SPEAKER, AND SENSOR WITH ALERT DEVICE ATTACHED

TECHNICAL FIELD

The present invention relates to a piezoelectric speaker, a piezoelectric audio device employing piezoelectric speaker, and a sensor with an alert device attached, and more particularly, to the improvement of the sound pressure of a piezoelectric speaker using a piezoelectric element.

BACKGROUND ART

In the related art, piezoelectric speakers using a piezoelectric vibrator in which a piezoelectric element is attached to a metal plate are known. Since piezoelectric speakers are thin and simple in structure as compared to dynamic speakers, piezoelectric speakers have advantages in that they can be miniaturized and are less expensive. However, piezoelectric speakers have disadvantages in that although they have a high sound pressure level near the resonance frequency thereof, the sound pressure level at other frequencies, particularly in a low-frequency domain, is low. In this specification, a low-frequency domain (hereinafter referred to as a low-frequency band) indicates frequencies of about 1 kHz or less, and a high-frequency domain (hereinafter referred to as a high-frequency band) indicates frequencies over about 1 kHz. However, there is no definite boundary between the low-frequency band and the high-frequency band.

Moreover, a piezoelectric speaker in which a piezoelectric vibrator is held by a film-shaped body formed of a resin to thereby increase a sound pressure level at a low-frequency band is known (for example, see Patent Document 1). Moreover, a piezoelectric audio device in which a metal plate for adjusting a resonance frequency is attached to a piezoelectric vibrator to thereby increase a sound pressure level at any frequency is known (for example, see Patent Document 2).

However, in such a piezoelectric speaker, the sound pressure level at the low-frequency band is still low, and it is not possible to obtain a sufficient sound pressure level.

RELATED ART DOCUMENTS

Patent Documents

Patent Document 1: JP-A-9-271096
Patent Document 2: JP-A-10-126885

SUMMARY OF THE INVENTION

Problem to be Solved by the Invention

The invention has been made in view of the above-described circumstance, and an object of the invention is to provide a piezoelectric speaker having a high sound pressure level in a low-frequency domain and a high-frequency domain, and a piezoelectric audio device and a sensor with an alert device attached, employing the piezoelectric speaker.

Means for Solving the Problem

In order to attain the object, the invention provides a piezoelectric speaker including: a piezoelectric vibrator including a piezoelectric body formed of a piezoelectric element and a plate-shaped body which has a larger diameter than the piezoelectric body and which is attached to a surface of the piezoelectric body in a concentric form; and a film-shaped body that is provided around the piezoelectric vibrator so as to elastically hold the piezoelectric vibrator, wherein the film-shaped body includes a coarse and dense portion in a circumferential direction thereof, which has a physically coarse portion which can become a mountain portion or a valley portion or both, and which is disposed so as to correspond to a natural frequency of an in-phase mode in which antinodes and nodes are formed in a concentric form, and wherein the piezoelectric vibrator and the film-shaped body form a sound producing body.

According to this configuration, the film-shaped body has a coarse and dense portion in a circumferential direction thereof, which has a physically coarse portion which can become a mountain portion or a valley portion, or both, and which is disposed so as to correspond to the natural frequency of the in-phase mode in which antinodes and nodes are formed in a concentric form. Therefore, it is possible to increase the displacement of the film-shaped body constituting the vibrating portion of the piezoelectric speaker at the frequency forming the in-phase mode to thereby improve the sound pressure level. For example, in addition to the structure in which the mountain portion or the valley portion, or both are formed in the circumferential direction, the amplitude can be further increased by alternately forming the coarse and dense portion or a region having a large elastic modulus and a region having a small elastic modulus in a concentric form with a planar shape so that the mountain portion or the valley portion, or both can be easily formed in the circumferential direction.

In the piezoelectric speaker of the invention, the film-shaped body may have a bellows structure which is provided around the piezoelectric vibrator so as to hold the piezoelectric vibrator, which has a mountain portion or a valley portion or both in the circumferential direction thereof, and which elastically holds the piezoelectric vibrator.

According to this configuration, the film-shaped body has the mountain portion or the valley portion, or both in the circumferential direction thereof. Therefore, it is possible to increase the displacement of the film-shaped body constituting the vibrating portion of the piezoelectric speaker at the frequency forming the in-phase mode to thereby improve the sound pressure level.

In the piezoelectric speaker of the invention, the bellows structure of the film-shaped body may be configured such that an antinode of the bellows is identical to an apex of the antinode of a vibration mode (the in-phase mode of the natural frequency).

According to this configuration, it is possible to further increase the displacement in the vibration mode (the natural vibration mode) of the natural frequency.

In the piezoelectric speaker of the invention, no bellows (a mountain portion and a valley portion) may be present at a position of the node of the vibration mode.

According to this configuration, since the position of the node of the natural vibration mode is not displaced, it is possible to further increase the displacement in the vibration mode.

In the piezoelectric speaker of the invention, the bellows structure of the film-shaped body may be configured such that the bellows and the antinodes of the vibration mode correspond to each other in a one-to-one correspondence, and the apex of the antinode of the bellows is identical to the apex of the antinode of the vibration mode.

According to this configuration, the apex of the antinode of the bellows is identical to the apex of the antinode of the vibration mode. Therefore, it is possible to further increase the displacement in the vibration mode.

In the piezoelectric speaker of the invention, the natural frequency may be a resonance point between 2 kHz and 4 kHz.

According to this configuration, by setting the frequency range to its maximum loudness, it is possible to emit a sensation of loud sound.

In the piezoelectric speaker of the invention, an edge of the film-shaped body may be held by an elastic body.

According to this configuration, since the film-shaped body can be attached without using an adhesive agent, productivity is improved. Moreover, the acoustic impedance increases, and a driving current can be decreased.

In the piezoelectric speaker of the invention, the elastic body may be polyurethane foam or thermoplastic elastomer.

In the piezoelectric speaker of the invention, the plate-shaped body may be a metal plate.

According to this configuration, since the plate-shaped body can be adhesively attached to a piezoelectric body, it is possible to form a uni-morph structure and to form a high-efficiency piezoelectric speaker.

In the piezoelectric speaker of the invention, the metal plate and the piezoelectric body may have an approximately disc shape, and a ratio of a radius of the metal plate to that of the piezoelectric body may be approximately 10:4.

According to this configuration, it is possible to maximize the sound pressure level at frequencies of the 1st-order resonance frequency (1 kHz) or less.

In the piezoelectric speaker of the invention, the film-shaped body may be a resin film.

According to this configuration, it is easy to form a mountain portion or a valley portion on a film. Thus, it is possible to form a piezoelectric speaker at a low cost, which has favorable heat resistance and high reliability.

The invention also provides a sensor with an alert device attached, including a piezoelectric speaker, a sensor element configured to detect an event, and a driver configured to drive the piezoelectric speaker in accordance with an output of the sensor element.

According to this configuration, it is possible to provide a sensor which includes a sound producing body capable of emitting an alarm sound in the high-frequency band and an alarm voice in the low-frequency band, and which is less expensive and highly reliable.

The invention also provides a piezoelectric audio device including: a piezoelectric vibrator including a piezoelectric body formed of a piezoelectric element and a plate-shaped body which has a larger diameter than the piezoelectric body and which is attached to a surface of the piezoelectric body in a concentric form; a film-shaped body that is provided around the piezoelectric vibrator so as to elastically hold the piezoelectric vibrator; a frame that supports the outer periphery of the film-shaped body; and a resonator configured to resonate with a radiation sound emitted by the piezoelectric vibrator, wherein the film-shaped body includes a coarse and dense portion in a circumferential direction thereof, which has a physically coarse portion which can become a mountain portion or a valley portion or both, and which is disposed so as to correspond to a natural frequency of an in-phase mode in which antinodes and nodes are formed in a concentric form, wherein the frame is formed of a bottomed cylindrical body which has one open end and which has an inner wall configured to support a periphery of the film-shaped body so as to define a posterior air chamber between the film-shaped body and a bottom surface of the frame, and wherein the resonator is provided so as to cover an opening of the frame, and defines an anterior air chamber between the film-shaped body and the frame.

According to this configuration, since the amplitude of the piezoelectric vibrator is increased by the bellows structure of the film-shaped body, the sound pressure level in the low-frequency band and the high-frequency band increases.

In the piezoelectric audio device of the invention, the bellows structure may be provided in a vicinity of the frame of the film-shaped body.

According to this configuration, since the amplitude of the piezoelectric vibrator in the high-frequency band is increased by the bellows structure of the film-shaped body, the sound pressure level in the high-frequency band increases.

The piezoelectric audio device of the invention may include a reflection plate provided around the opening of the frame and configured to reflect the radiation sound toward a front side, wherein an outer circumference of the reflection plate may have a shape extending toward the front side with an approximately exponential curve.

According to this configuration, since the outer circumference of the reflection plate has an approximately exponential curve, the radiation sound is not likely to resonate at the outer circumference. Thus, it is possible to decrease the difference in the directivity of the radiation sound in the longitudinal direction and the lateral direction of the reflection plate.

In the piezoelectric audio device of the invention, the resonator may have a sound hole through which the radiation sound passes, and the sound hole may be provided between an opening position of the frame and an upper end position of the outer circumference of the reflection plate in a front and rear direction.

According to this configuration, it is possible to further decrease the difference in the directivity of the radiation sound in the longitudinal direction and the lateral direction of the reflection plate.

The piezoelectric audio device of the invention may include a plate-shaped horn cap provided on the front side of the resonator and configured to adjust a directivity of the radiation sound.

According to this configuration, since the transmission direction of the radiation sound is widened by the horn cap, it is possible to flatten the directivity of the radiation sound.

The piezoelectric audio device of the invention may include a duct that connects a space defined on the front side of the reflection plate and the posterior air chamber such that the resonance frequency is adjusted by the duct.

According to this configuration, since it is possible to create the resonance frequency in the low-frequency band by the presence of the duct, it is possible to increase the sound pressure level in the low-frequency band.

Advantages of the Invention

As described above, according to the invention, the film-shaped body that forms the sound producing body of the piezoelectric speaker has a coarse and dense portion in a circumferential direction thereof, which has a physically coarse portion, and which can become a mountain portion or a valley portion, or both, and is disposed so as to correspond to a natural frequency of an in-phase mode wherein antinodes and nodes are formed in a concentric form, and the piezoelectric vibrator and the film-shaped body form a sound producing body. Therefore, it is possible to increase the displacement of the piezoelectric speaker at the frequency forming the in-phase mode using the bellows structure of the film-shaped body to thereby improve the sound pressure level. Accordingly, the sound pressure level in the low-frequency band and the high-frequency band increases.

MODE FOR CARRYING OUT THE INVENTION

Figure 1:
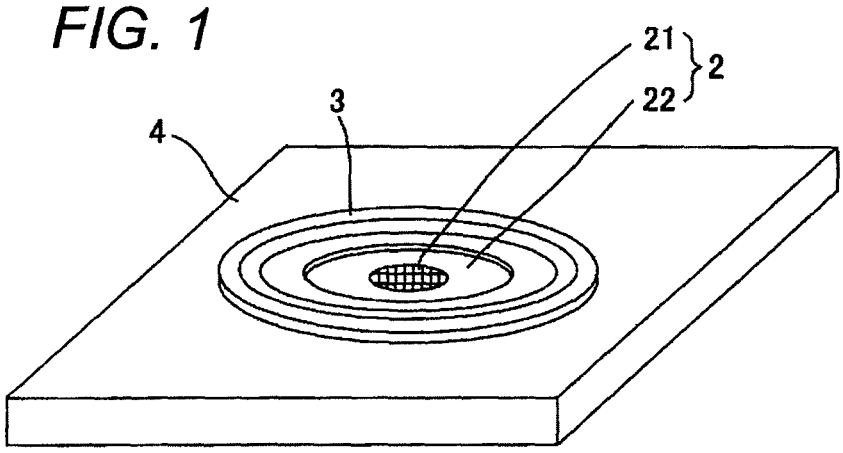
FIG. 1 is a configuration view of a piezoelectric speaker according to a first embodiment of the invention.
Figure 2:
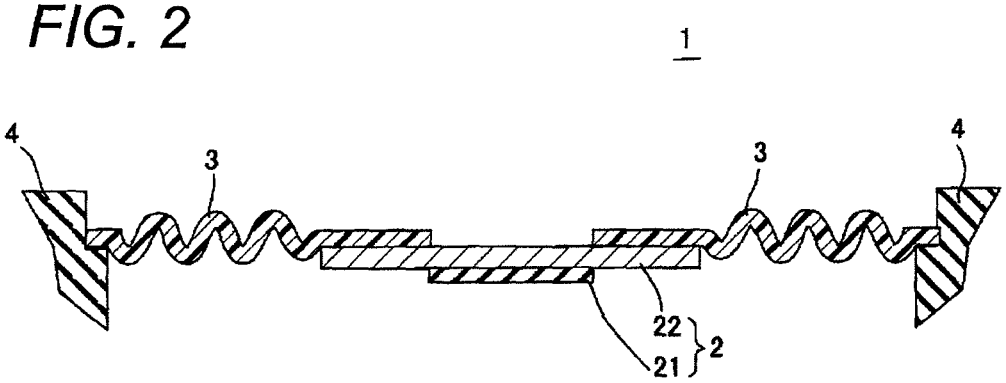
FIG. 2 is a cross-sectional view of the piezoelectric speaker.
Figure 3:
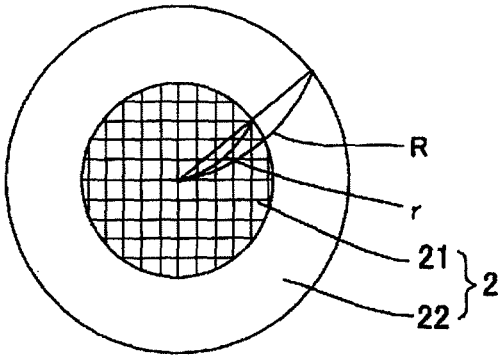
FIG. 3 is a configuration view of a piezoelectric vibrator of the piezoelectric speaker.
Figure 4A:
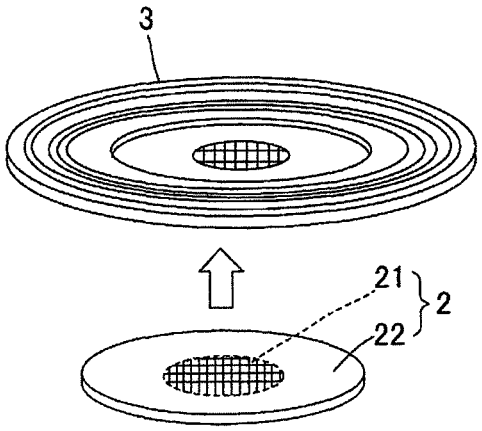
FIG. 4(*a*) is an exploded perspective view of the piezoelectric vibrator and film-shaped body of the piezoelectric speaker, and FIG. 4(*b*) is a perspective view of the piezoelectric vibrator and the film-shaped body.
Figure 4B:
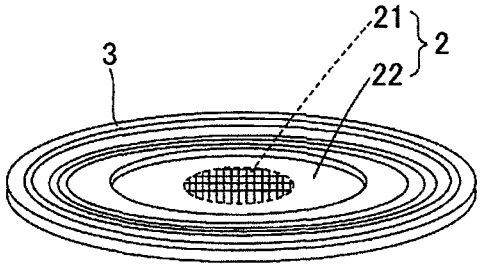

Hereinafter, embodiments of the invention will be described with reference to the drawings.

First Embodiment

A piezoelectric speaker according to a first embodiment of the invention will be described with reference to FIGS. 1 to 4. A piezoelectric speaker 1 according to the present embodiment includes a piezoelectric vibrator 2, a film-shaped body 3 provided around the piezoelectric vibrator 2 so as to hold the piezoelectric vibrator 2, and a frame 4 supporting the outer periphery of the film-shaped body 3. The film-shaped body 3 is configured by a bellows structure which has a mountain portion and a valley portion in a circumferential direction so as to correspond to a natural frequency of an in-phase mode wherein antinodes and nodes are formed in a concentric form. The piezoelectric vibrator and the film-shaped body form a sound producing body. The piezoelectric vibrator 2 includes a piezoelectric body 21 formed of a piezoelectric element and a metal plate used as a plate-shaped body 22 which has a larger diameter than the piezoelectric body 21 and which is concentrically attached to a surface of the piezoelectric body 21. The piezoelectric body 21 is a lead zirconium titanate having a thickness of 0.05 to 0.1 mm and a density of 8.0 (1E+3 kg/m$^3$), for example. The plate-shaped body 22 is a 42-nickel alloy (an iron-nickel alloy containing 42% of nickel) having a thickness of 0.05 to 0.1 mm and a density of 8.15 (1E+3 kg/m$^3$), for example. Preferably, the piezoelectric body 21 and the plate-shaped body 22 have the same thickness. The piezoelectric body 21 and the plate-shaped body 22 have their entire surface adhesively attached by an adhesive agent made of an epoxy resin, for example. A silver electrode is formed on the surface of the piezoelectric body 21 and is connected to a lead wire (not shown) through a lead-free solder. When a signal voltage is applied to the electrode, the piezoelectric body 21 is deformed, and the vibration thereof is emitted as sound (vibration of air).

Figure 5:
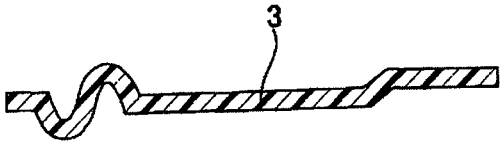
FIG. 5 is a simplified cross-sectional view of a main part of the film-shaped body of the piezoelectric speaker.
Figure 6A:
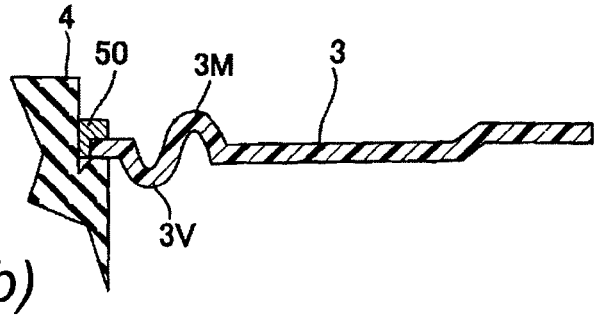
FIGS. 6(*a*) to 6(*d*) are views showing examples of the shape of the film-shaped body of the piezoelectric speaker.
Figure 6B:
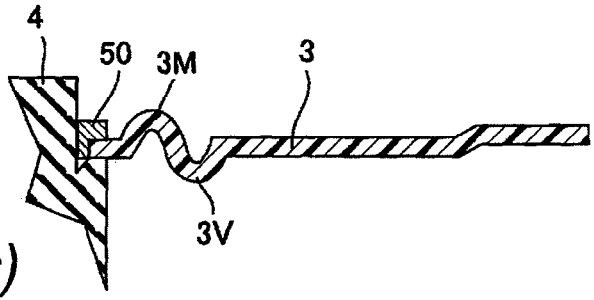
Figure 6C:
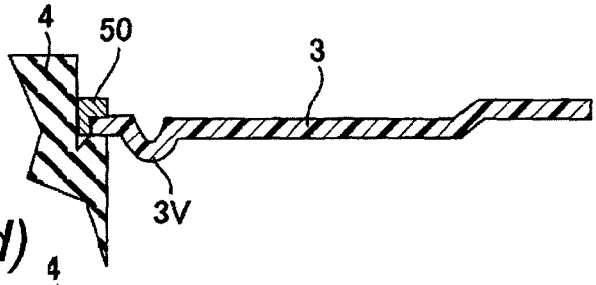
Figure 6D:
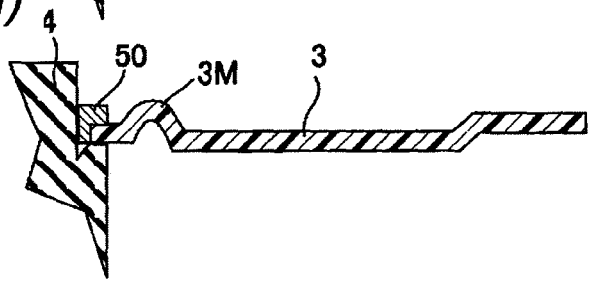

The film-shaped body 3 is a thin member that elastically holds the piezoelectric vibrator 2, and is a resin film such as PEI (polyetherimide), PEN (polyether naphthalate), or PC (polycarbonate), having a thickness of 50 to 188 μm, for example. The film-shaped body 3 forms a bellows structure which has a doughnut shape, in which the piezoelectric vibrator 2 is attached at the center by an adhesive agent, and which has a mountain portion and a valley portion corresponding to the natural frequency in the circumferential direction as described above. The bellows structure having a mountain portion 3M and a valley portion 3V, which are formed so as to correspond to the natural frequency, as the main part is simplified and shown in FIG. 5. In this example, a resonance frequency is used for the purpose of receiving signals of the frequencies 2 kHz to 4 kHz, and the distance λ between the mountain portion 3M and the valley portion 3V is set to about 0.7 mm.

The bellows structure of the film-shaped body 3 is elastically supported by the frame 4 used as a supporting portion through an elastic body (elastomer) 50, and is configured such that the antinodes of the bellows are identical to the apexes of the antinodes of a vibration mode (the in-phase mode of the natural frequency). Thus, it is possible to further increase a displacement in the vibration mode.

Moreover, the natural frequency is set to be a resonance point between the frequencies of 2 kHz to 4 kHz. Thus, by setting the frequency range to its maximum loudness, it is possible to emit a sensation of loud sound.

The bellows structure may have a configuration in which the valley portion 3V and the mountain portion 3M are alternately formed in that order from the side of the frame 4 as shown in FIG. 6(*a*) and may have a configuration in which the mountain portion 3M and the valley portion 3V are alternately formed in that order from the side of the frame 4 as shown in FIG. 6(*b*). Moreover, the bellows structure may include only the valley portion 3V as shown in FIG. 6(*c*), and may include only the mountain portion 3M as shown in FIG. 6(*d*).

Figure 7A:
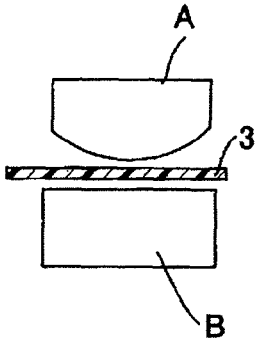
FIGS. 7(*a*) to 7(*c*) are views showing the process of manufacturing the film-shaped body of the piezoelectric speaker.
Figure 7B:
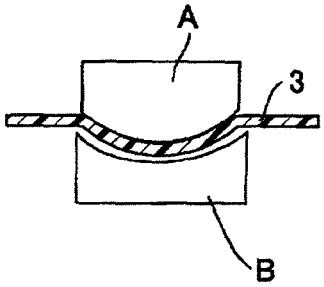
Figure 7C:
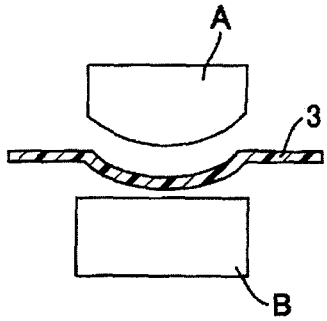

An example of a method of manufacturing the bellows structure of the film-shaped body 3 will be described with reference to FIGS. 7(*a*) to 7(*c*). In this example, the film-shaped body 3 is a resin film and is molded by a heated mold as an example of a molding method. First, as shown in FIG. 7(*a*), the film-shaped body 3 is placed between a mold A and a rubber member B, and the mold A is heated to a predetermined temperature. The mold A is processed to have the shape of the bellows. Subsequently, as shown in FIG. 7(*b*), the mold A is pressed against the rubber member B with the film-shaped body 3 disposed therebetween. Subsequently, as shown in FIG. 7(*c*), the mold A is opened so as to remove the film-shaped body 3. The film-shaped body 3 is shaped into the bellows structure in accordance with the shape of the mold.

The frame 4 is formed of a resin, for example and provided around the film-shaped body 3, and has a flat surface where the film-shaped body 3 is placed. On this flat surface, the film-shaped body 3 is elastically held by the elastic body 50 as described above.

Figure 8A:
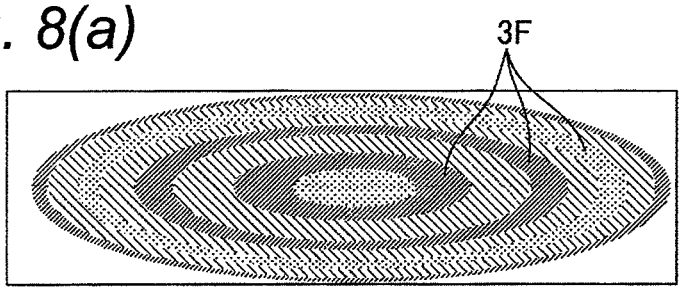
FIG. 8(*a*) is a view showing the vibration state of a piezoelectric vibrating body of the piezoelectric speaker, FIG. 8(*b*) is a view showing the configuration of the piezoelectric vibrating body, and FIG. 8(*c*) is a graph showing the displacement of a sound pressure level when the film-shaped body has a bellows structure and when the film-shaped body does not have a bellows structure.
Figure 8B:
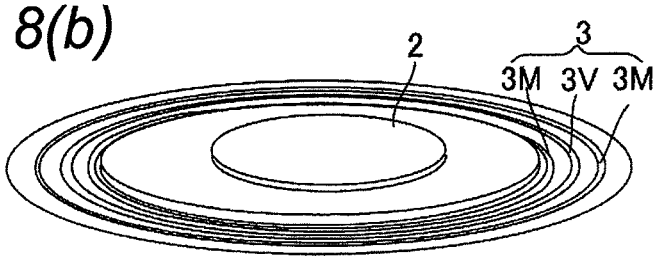
Figure 8C:
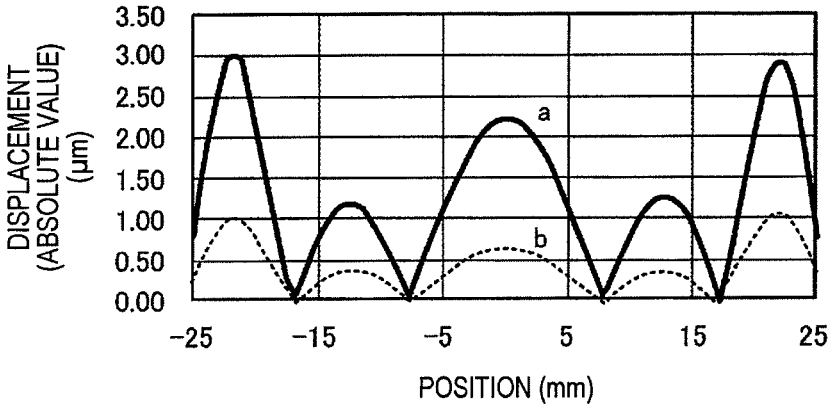

A radiation sound emitting operation of the piezoelectric speaker 1 according to the present embodiment having the above-described configuration will be described with reference to FIGS. 8(*a*) to 8(*c*). FIGS. 8(*a*) to 8(*c*) show a vibration mode (FIG. 8(*a*)), the configuration of the film-shaped body (FIG. 8(*b*)), and the sound pressure output of the piezoelectric speaker 1 (FIG. 8(*c*)) when the mountain portion 3M and the valley portion 3V of the bellows structure of the film-shaped body 3 are formed at positions corresponding to the antinodes of the resonance frequency of the in-phase mode. Although the piezoelectric body 21 is contracted and expanded when a signal voltage of a radiation sound is applied to the piezoelectric body 21, since the plate-shaped body 22 formed of a metal plate, to which the piezoelectric body 21 is attached, is not contracted and expanded, the piezoelectric vibrator 2 recurves. The piezoelectric vibrator 2 vibrates by repeating this recurving operation and emits a radiation sound. In the film-shaped body 3 having the bellows structure, the film-shaped body 3 is likely to recurve at the position of the bellows structure, and is likely to be expanded and contracted in the circumferential direction when the bellows structure recurves.

In a vibration mode near 3 kHz (3rd-order resonance frequency) of the sound producing body, vibration occurs in a concentric form as shown in FIG. 8(*a*), and thus, antinodes and nodes of the vibration can be made to occur alternately. Therefore, focusing on antinode portions 3F of the film-shaped body 3, as shown in FIG. 8(*b*), when a bellows structure is formed so that a bellows is formed on the antinode portions 3F to form the mountain portion 3M and the valley portion 3V, a vibration displacement increases. There is a large difference in the displacement when the bellows is formed on the antinodes of the vibration mode as depicted by curve 'a' in FIG. 8(*c*) and when no bellows is formed as depicted by curve 'b'. However, in this simulation, air resistance is not taken into account.

As described above, the amplitude of the piezoelectric vibrator 2 at a target natural frequency increases as depicted by curve 'a' in FIG. 8(*c*), and the sound pressure level of the radiation sound emitted by the piezoelectric speaker 1 increases.

Figure 9A:
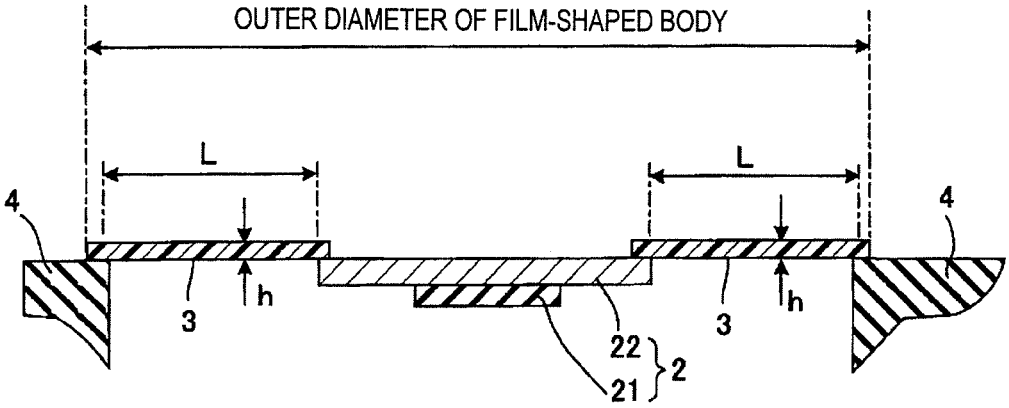
FIG. 9(*a*) is a view showing the cross section of the piezoelectric speaker, and FIG. 9(*b*) is a view showing the vibration model of the piezoelectric speaker.
Figure 9B:
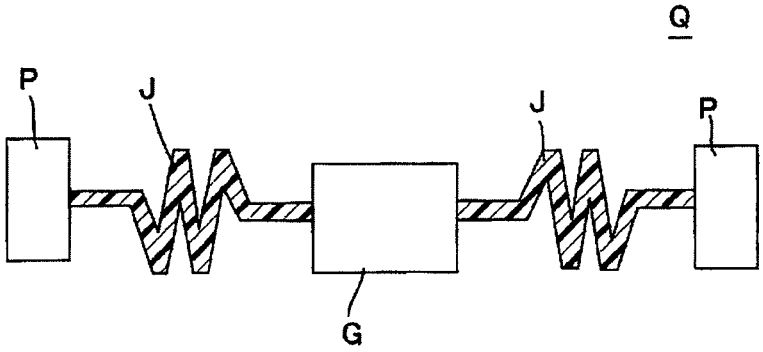

The resonance frequency of the piezoelectric speaker 1 will be described with reference to FIGS. 9(*a*) and 9(*b*). FIG. 9(*a*) shows the cross section of the piezoelectric speaker 1, and FIG. 9(*b*) is a modeling diagram of the piezoelectric speaker 1. In FIG. 9(*a*), the bellows structure of the film-shaped body 3 is not illustrated. As shown in FIG. 9(*b*), the piezoelectric speaker 1 can be regarded as a vibrating structure Q in which a weight G is supported by a support P through a spring J. If the spring constant of the spring J is k, and the mass of the weight G is m, the resonance frequency f of the vibrating structure Q can be expressed by the following expression.

$$f=1/(2\pi)\cdot(k/m)^{1/2}$$

Therefore, if the spring constant of the film-shaped body 3 is $k_0$, and the mass of the piezoelectric vibrator 2 is $m_0$, the resonance frequency $f_0$ of the piezoelectric speaker 1 can be expressed by the following expression.

$$f_0=1/(2\pi)\cdot(k_0/m_0)^{1/2}$$

Moreover, if the Young's modulus of the film-shaped body 3 is E, the thickness of the film-shaped body 3 is h, and the radial length of the film-shaped body 3 is L, the spring constant $k_0$ of the film-shaped body 3 can be expressed by the following expression.

$$k_0=E\cdot h^3/L^2/4$$

The piezoelectric speaker 1 without the bellows structure, of which the measurement results are depicted by curve 'b' in FIG. 8(*c*) has a configuration in which the outer diameter of the film-shaped body 3 is 53 mm, the radial length $L_1$ of the film-shaped body 3 is 7 mm, and the resonance frequency $f_1$ is 180 Hz. On the other hand the piezoelectric speaker 1 having the bellows structure depicted by curve 'a' has a configuration in which the outer diameter of the film-shaped body 3 is 50 mm, and the radial length $L_2$ of the film-shaped body 3 is 6 mm. Moreover, in both piezoelectric speakers 1 without the bellows structure and with the bellows structure, the film-shaped bodies 3 have the same Young's modulus E, the film-shaped bodies 3 have the same thickness h, and the piezoelectric vibrators 2 have the same mass $m_0$. Therefore, the ratio of the resonance frequency $f_2$ of the piezoelectric speaker 1 having the bellows structure to the resonance frequency $f_1$ of the piezoelectric speaker 1 without the bellows structure is expressed as follows.

$$f_2/f_1=L_1/L_2=7/6$$

Thus, the resonance frequency $f_2$ is about 1.2 times the resonance frequency $f_1$, peaks having high sound pressure levels appear near 210 Hz and 100 Hz. In such a piezoelectric speaker 1, the sound pressure level can be increased by increasing the outer diameter of the film-shaped body 3. However, when the outer diameter of the film-shaped body 3 is limited, as described above, the sound pressure level at any frequency domain can be increased by changing the Young's modulus, thickness, and radial length of the film-shaped body 3 to thereby change the resonance frequency.

Figure 10A:
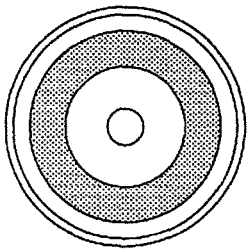
FIG. 10(*a*) is a view showing the displacement of a piezoelectric vibrating body in a vibration mode at its resonance frequency, and FIGS. 10(*b*) and 10(*c*) are views showing the displacement of a piezoelectric vibrating body in vibration modes at frequencies other than its resonance frequency.
Figure 10B:
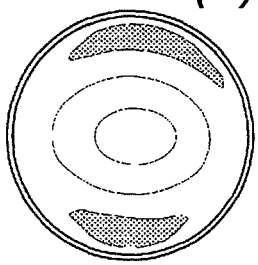
Figure 10C:
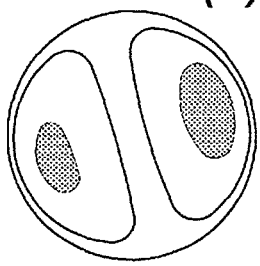

In the present embodiment, the bellows structure of the film-shaped body 3 has a configuration in which the antinodes of the bellows are identical to the apexes of the antinodes of the vibration mode (the in-phase mode of the natural frequency). According to the simulation results, as shown in FIG. 10(*a*), the antinodes and nodes of the vibration are formed in a concentric form. On the other hand, in a vibration mode other than the resonance frequency, the displacement is dispersed as shown in FIGS. 10(*b*) and 10(*c*). As can be understood from the comparison of these drawings, the displacement in the vibration mode can be further increased when the vibration mode becomes the in-phase mode.

Figure 11:
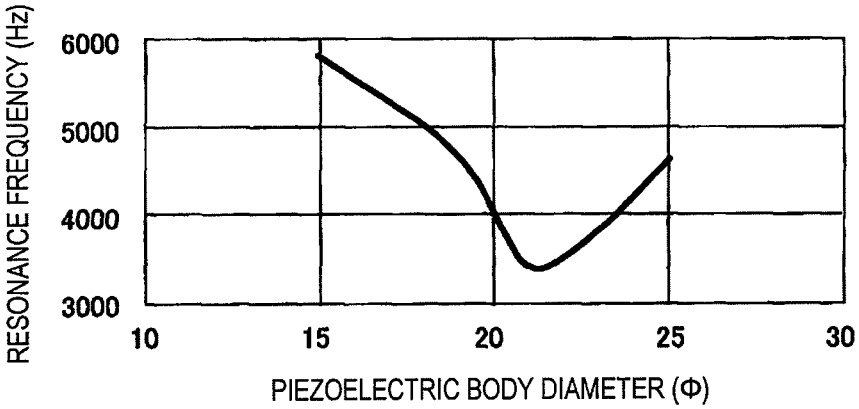
FIG. 11 is a graph showing the relationship between a change in the diameter of a piezoelectric body and the resonance frequency thereof.

Moreover, in the present embodiment, the plate-shaped body 22 and the piezoelectric body 21 formed of a metal plate have an approximately disc shape, and the ratio R:r of the radius of the plate-shaped body 22 to that of the piezoelectric body 21 is set to 10:4. FIG. 11 shows a change in the resonance frequency when the diameter of the piezoelectric body 21 is changed with the diameter of the plate-shaped body 22 maintained to be constant. The piezoelectric body 21 and the plate-shaped body 22 are circular, and the diameter of the plate-shaped body 22 is 50 mm. The resonance frequency is the lowest when the diameter of the piezoelectric body 21 is near 23 mm, and in this case, the ratio of the radius of the plate-shaped body 22 to that of the piezoelectric body 21 is about 10:4. The ratio of the radius of the plate-shaped body 22 to that of the piezoelectric body 21 is preferably about 10:4. Therefore, since the resonance frequency of the piezoelectric speaker 1 decreases when the configuration of the present embodiment is used, it is possible to increase the sound pressure level at a low-frequency band.

Figure 12:
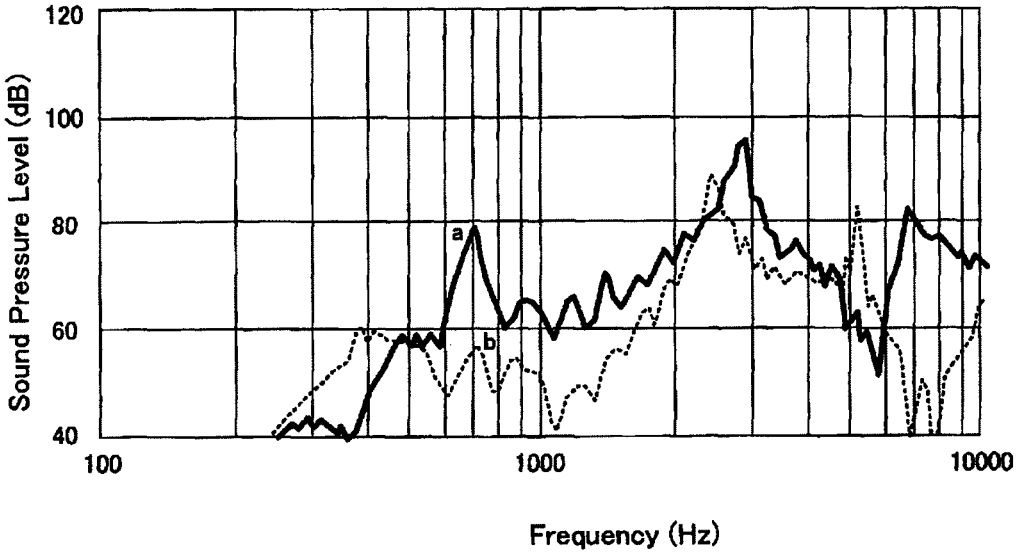
FIG. 12 is a graph showing the relationship between a sound pressure level and a frequency when the diameter of a piezoelectric body is changed.

Moreover, the measurement results of the relationship between the frequency and the sound pressure level in the above case are depicted by curve 'a' in FIG. 12.

For comparison, the measurement results of the relationship between the frequency and the sound pressure level when the ratio R:r of the radius of the plate-shaped body 22 to that of the piezoelectric body 21 is about 10:6 are depicted by curve 'b' in FIG. 12. In all cases, although it is possible to obtain the desired resonance frequencies 2 to 4 kHz, the case of curve 'a' is advantageous in that the 1st-order resonance frequency can be obtained. As described above, by setting the ratio R:r of the radius of the plate-shaped body 22 to that of the piezoelectric body 21 to about 10:4, it is possible to increase the sound pressure level at a low-frequency band of 1 kHz or less.

In the above embodiment, although a metal plate is used as the plate-shaped body, the plate-shaped body is not limited to the metal plate but may be a material (for example, a unimorph type material) in which a flexed state is created when a piezoelectric element is expanded and contracted within a plane.

Second Embodiment

Next, a second embodiment of the invention will be described.

Figure 13A:
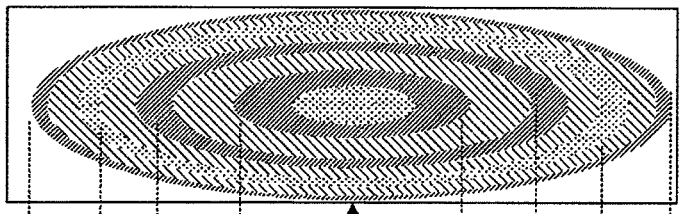
FIG. 13(*a*) is a view showing the vibration state of a piezoelectric speaker according to a second embodiment, FIG. 13(*b*) is a view showing the vibration waveform of the piezoelectric speaker, and FIG. 13(*c*) is a cross-sectional view of the main part of the piezoelectric speaker.
Figure 13B:
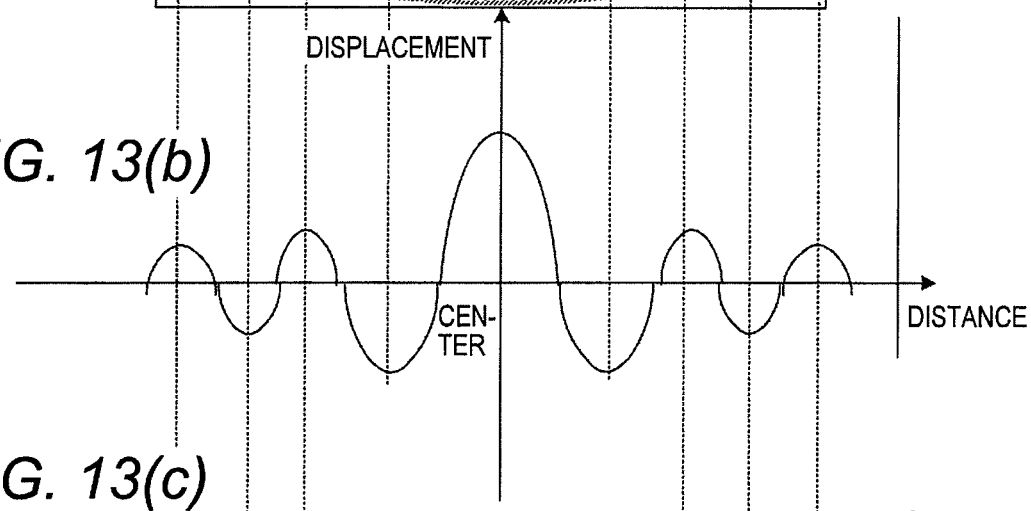
Figure 13C:
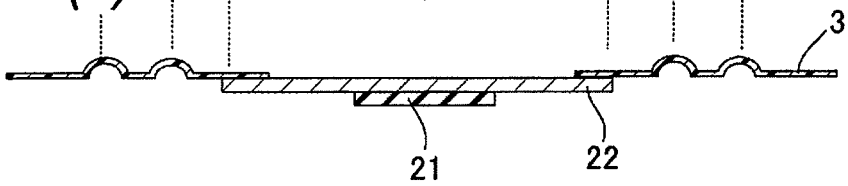

In the present embodiment, as shown in FIGS. 13(*a*) to 13(*c*), the bellows structure of the film-shaped body 3 has a configuration in which the bellows and the antinodes of the vibration mode correspond to each other in a one-to-one correspondence, and no bellows (the mountain portion and the valley portion) is present at the positions of the nodes of the vibration mode. In this embodiment, the piezoelectric speaker has the same structure as the first embodiment except for the shape of the bellows.

A radiation sound emitting operation of the piezoelectric speaker 1 according to the present embodiment having the above-described configuration will be described with reference to FIGS. 13(*a*) to 13(*c*). FIGS. 13(*a*) to 13(*c*) show a vibration mode (FIG. 13(*a*)), the displacement of the vibrating portion of the piezoelectric speaker (FIG. 13(*b*)), and the configuration of the film-shaped body (FIG. 13(*c*)) when the mountain portion 3M and the valley portion 3V of the bellows structure of the film-shaped body 3 are formed so as to correspond to the antinodes of the resonance frequency of the in-phase mode in a one-to-one correspondence. Similarly, in this embodiment, although the piezoelectric body 21 is contracted and expanded when a signal voltage of a radiation sound is applied to the piezoelectric body 21, since the plate-shaped body 22 to which the piezoelectric body 21 is attached is not contracted and expanded, the piezoelectric vibrator 2 recurves. The piezoelectric vibrator 2 vibrates by repeating this recurving operation and emits a radiation sound. In the film-shaped body 3 having the bellows structure, the film-shaped body 3 is likely to recurve at the position of the bellows structure, and is likely to be expanded and contracted in the circumferential direction when the bellows structure recurves.

In a vibration mode near 1 kHz which is the 1st-order resonance frequency of the sound producing body, vibration occurs in a concentric form as shown in FIG. 13(*a*), and thus, antinodes and nodes of the vibration can be made to occur alternately. Therefore, as shown in FIG. 13(*b*), the displacement of the film-shaped body 3 is large at the position of the piezoelectric element, and the vibration displacement propagates in a one-to-one correspondence to the bellows structure in which the bellows is formed around the piezoelectric element to form the mountain portion 3M and the valley portion 3V.

As described above, the amplitude of the piezoelectric vibrator 2 at a target natural frequency increases as depicted by a curve in FIG. 13(*b*), and it is possible to further increase the sound pressure level of the radiation sound emitted by the piezoelectric speaker 1.

Third Embodiment

Next, a third embodiment of the invention will be described.

Next, the measurement results of the 3rd-order resonance will be described.

Figure 14:
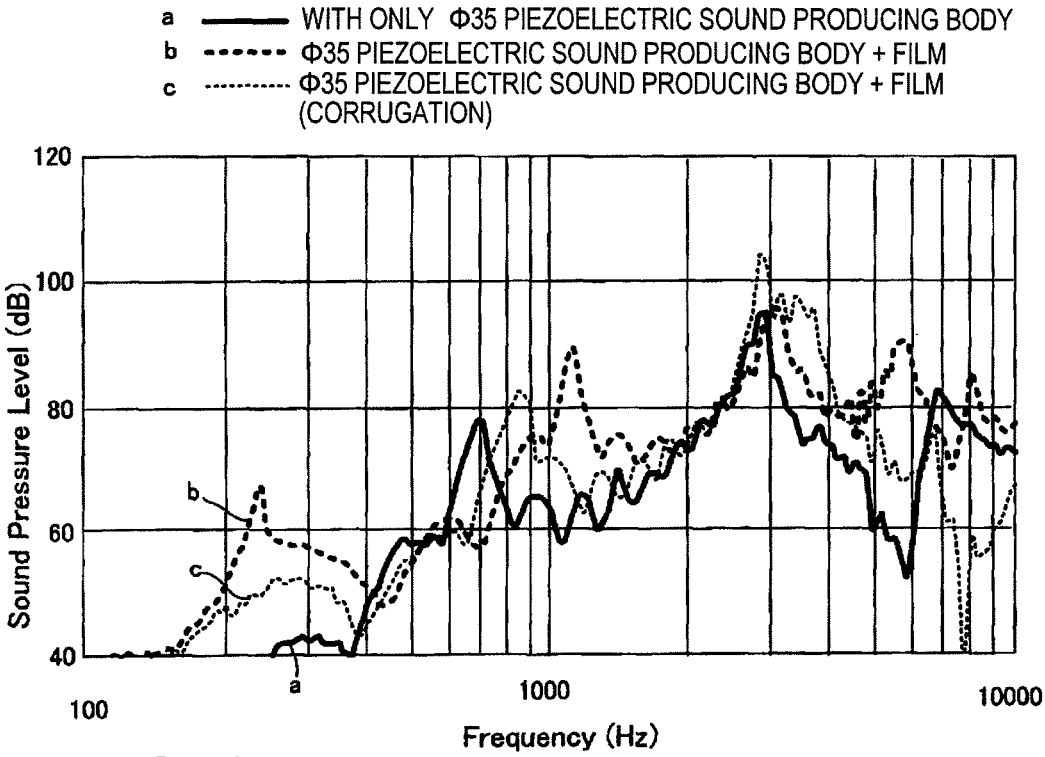
FIG. 14 is a graph showing a change in the sound pressure level with respect to a frequency in a third embodiment of the invention, when no film-shaped body is attached, when a film-shaped body is attached, and when a film-shaped body having an in-phase mode bellows structure is attached.

The measurement results of the relationship between the sound pressure level and the resonance frequency are shown in FIG. 14. In the measurement, the same piezoelectric vibrator 2 as the first embodiment shown in FIGS. 1 to 4 is formed to a size of 35ϕ. In FIG. 14, curve 'a' shows a case of only the 35ϕ piezoelectric vibrator 2, curve 'b' shows a case when a 50ϕ film-shaped body 3 is connected to the 354 piezoelectric vibrator 2, and curve 'c' shows a case when a 50ϕ film-shaped body 3 having a bellows is connected to the 35ϕ piezoelectric vibrator 2.

Figure 15:
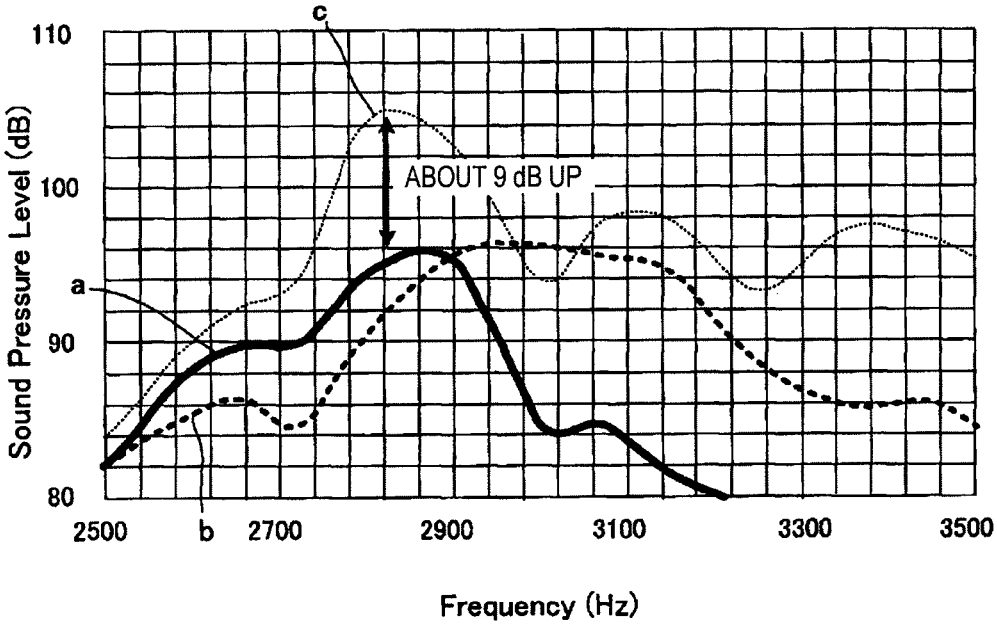
FIG. 15 is a graph showing the main part of the above graph in an enlarged scale.

Moreover, FIG. 15 is an enlarged view near the 3rd-order resonance point.

As is clear from the drawing, the sound pressure level in the low-frequency band is improved for curve 'b', and the sound pressure level near 3 kHz is improved for curve 'c'.

In the first to third embodiments described above, paper made of wood pulp and paper made of non-wood plant such as paper mulberry, paper bush, or bamboo may be used as the film-shaped body in addition to a resin film. Moreover, a nonwoven fabric, a material in which an adhesive agent is impregnated into a nonwoven fabric so as to enhance rigidity, a material in which urethane is coated on polyester, titanium, aluminum, and the like may be used.

Fourth Embodiment

A fourth embodiment of the invention will be described.

Figure 16:
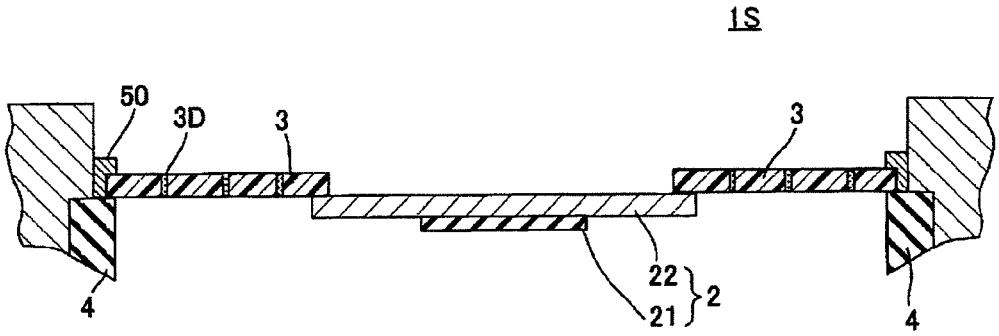
FIG. 16 is a cross-sectional view showing the main part of a piezoelectric speaker according to a fourth embodiment of the invention.

In the first to third embodiments described above, although a film-shaped body having a bellows structure has been used, in a piezoelectric speaker 1S of the present embodiment, doping is performed on a flat film-shaped body 3 as shown in FIG. 16, which does not have a bellows structure, so as to form doping regions 3D. In the present embodiment, by selectively forming regions having a high elastic modulus, it is possible to form a piezoelectric speaker in which the doping regions 3D become nodes so as to correspond to the resonance frequency.

Similarly, with this configuration, it is possible to increase the sound pressure level at the 3rd-order resonance.

In the fourth embodiment, paper made of wood pulp and paper made of non-wood plant such as paper mulberry, paper bush, or bamboo may be used as the film-shaped body in addition to a resin film. Moreover, a nonwoven fabric, a material in which an adhesive agent is impregnated into a nonwoven fabric in a concentric form at predetermined intervals corresponding to the resonance frequency so as to enhance rigidity to thereby form regions having a high Young's modulus, a material in which urethane is selectively coated on polyether in a concentric form at predetermined intervals corresponding to the resonance frequency, a material in which impurities are selectively doped into titanium, aluminum, or the like in a concentric form at predetermined intervals corresponding to the resonance frequency so as to change the properties thereof, and the like may be used.

Moreover, regions serving as antinodes may be configured by thin regions so that the elastic modulus thereof is lower than other regions. For example, a laser beam may be selectively emitted to titanium, aluminum, or the like in a concentric form at predetermined intervals corresponding to the resonance frequency so as to evaporate a part thereof and form thin regions.

Similarly, in these cases, the same effect as a case of forming a coarse and dense portion having a physically coarse portion is obtained. Thus, the piezoelectric speaker is likely to resonate, and it is possible to increase the displacement and obtain a higher sound pressure level.

Fifth Embodiment

A fifth embodiment of the invention will be described.

In the present embodiment, a fire alarm using the piezoelectric speaker described in the first embodiment will be described.

Figure 17:
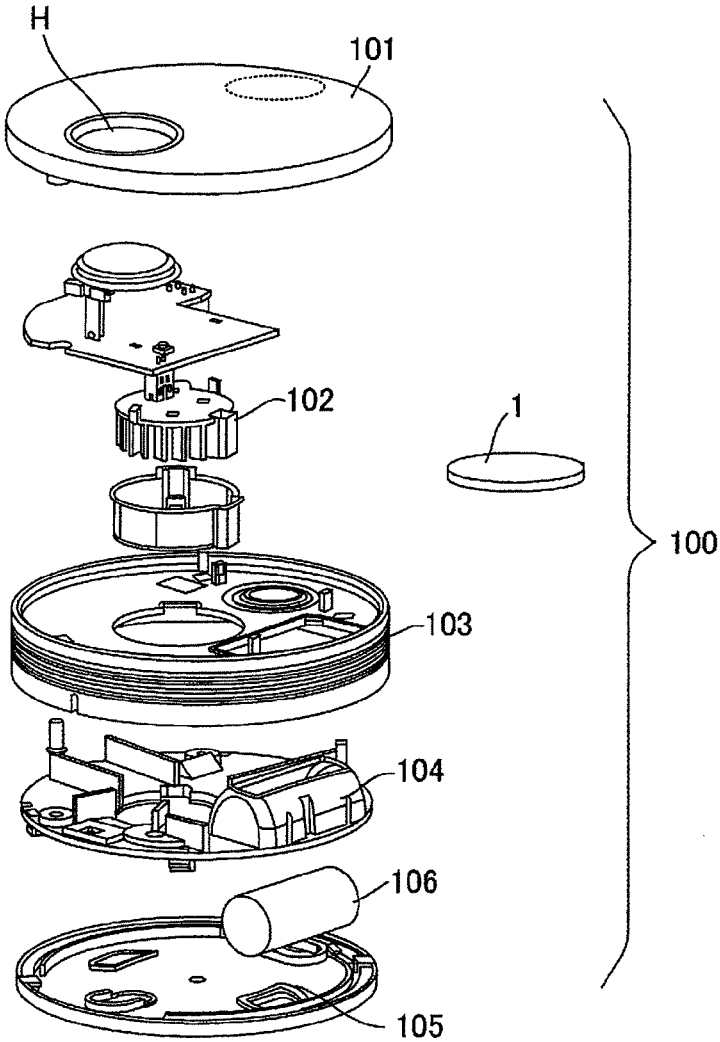
FIG. 17 is an exploded perspective view showing a fire alarm using a piezoelectric speaker according to a fifth embodiment of the invention.

The fire alarm is configured such that when a fire breaks out, a smoke detector detects smoke and informs residents about the fire by outputting sound (a warning sound such as "Beep, Beep, Beep" or an alarm voice such as "Fire has broken out" or "Battery has been exhausted"). As shown in FIG. 17, a piezoelectric speaker 1 is inserted between a body 103 and an optical smoke detector 102, and is attached to a base 105 together with a rear cover 104 and a battery 106. Reference numeral 101 is a cover having a hole H.

Since these fire alarms are attached to a living room, a bedroom, a stair, a hall way, and the like of a single-family house, they need to be made compact and thin so as not to disturb the interior design so that they can be installed at any place. In the invention, by using a thin piezoelectric speaker, it is possible to output an alarm voice in a low-frequency band similarly to dynamic speakers and output a warning sound (resonance frequency).

The smoke detector is configured by the optical smoke detector 102 and has a configuration in which a change in the voltage from a smoke detection sensor is captured into one of the terminals of a device chip having an ADC (analog/digital conversion) function. The captured signal is internally processed, and a buzzer outputs sound when the signal level reaches a predetermined level or higher. The buzzer output is amplified by the piezoelectric speaker 1. That is, a through hole having a predetermined size is drilled through the center of the optical smoke detector 102 along its longitudinal direction. A high-brightness LED (transmission element) is inserted into one opening of the hole, and a phototransistor (reception element) is inserted into the other opening.

These two transmission and reception elements are spaced by about 70 mm in terms of a tip-to-tip distance.

Moreover, a hole having the same size of 4.2 mm is drilled through the central portion of the square-shaped member in a direction orthogonal to the longitudinal through hole. Smoke passes through this hole to block light from the LED, which decreases the amount of light reaching the phototransistor and increases the voltage value input to the terminal. For example, a VR (10K) of a light source LED is adjusted to about 6.8 KW to supply current of 0.37 mA to the LED. In this state, when a VR (20 k) on the phototransistor side is adjusted appropriately, the voltage value input to the device chip is around 0.6 V when there is no smoke and increases up to about 3 V (maximum) when smoke enters. That is, the presence of smoke is detected by a difference in the voltage values. When smoke enters the hole, and the concentration thereof reaches a predetermined value or higher, a counter measures duration of this state. When this state continues for about 6 seconds, sound (a warning sound such as "Beep, Beep, Beep") is output for about 150 seconds and is then stopped. However, when the high concentration state of the smoke is continuously maintained, the warning sound is continuously output.

Figure 18:
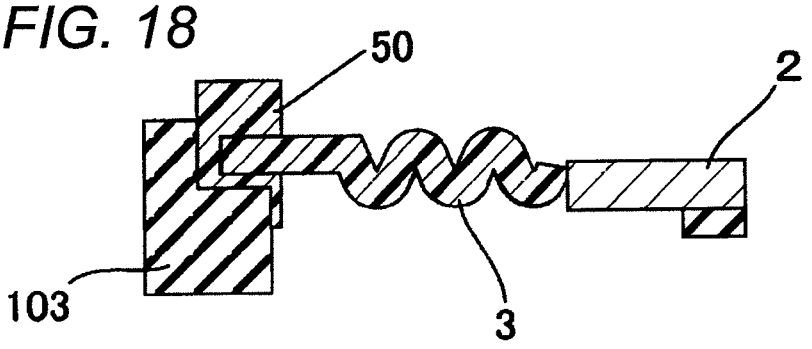
FIG. 18 is an enlarged cross-sectional view of the main part of the above drawing.

The piezoelectric speaker has the film-shaped body 3 having the same bellows structure as described in the first embodiment. Thus, as depicted by a main part enlarged view in FIG. 18, the elastic body 50 (which is molded at the same time as a cover or a body formed of a thermoplastic elastomeric ABS resin) formed of a ring-shaped elastomer is attached to the cover or the body 103 (formed of an ABS resin), and the film-shaped body 3 is inserted.

As described above, due to the insertion-type fixing method using an elastic body, the piezoelectric speaker has weak binding force and high acoustic impedance as compared to the fixing method using an adhesive agent. As shown in the drawing, the residential fire alarm includes a module or the like for detecting smoke in an optical method as the optical smoke detector 102 in addition to the speaker.

The elastic body for supporting the film-shaped body with respect to the frame is not limited to the thermoplastic elastomer, but an elastic body such as polyurethane foam may be used.

Moreover, in the embodiment described above, although a fire alarm using a smoke detector has been described, the invention is not limited to the fire alarm, but can be applied to an alert device that outputs a warning sound in accordance with detection results of various sensors such as an alert device attached to the door of a refrigerator or an abnormality alarm of a washing machine.

The invention is not limited to the configurations of the embodiments described above, but various modifications can be made without departing from the spirit of the invention. For example, in the embodiments described above, although the film-shaped body 3 is provided on the entire periphery of the piezoelectric vibrator 2 so as to hold the piezoelectric vibrator 2, the film-shaped body 3 may be provided on a part of the periphery of the piezoelectric vibrator 2.

Moreover, the way in which the piezoelectric speaker configured by the piezoelectric vibrator is mounted is not limited to the embodiments described above but may be changed appropriately.

Sixth Embodiment

Figure 19A:
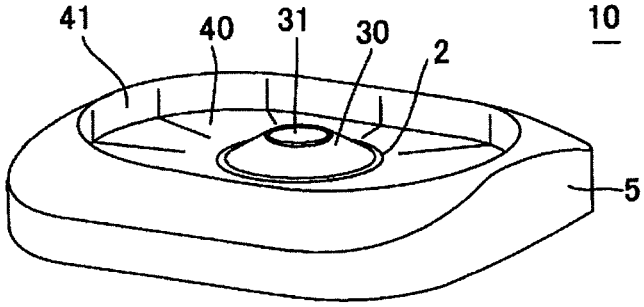
FIGS. 19(*a*) to 19(*c*) are views showing a piezoelectric audio device according to a sixth embodiment of the invention, in which FIG. 19(*a*) is a configuration view, FIG. 19(*b*) is a cross-sectional view of the piezoelectric audio device, and FIG. 19(*c*) is an exploded perspective view of the piezoelectric audio device.
Figure 19B:
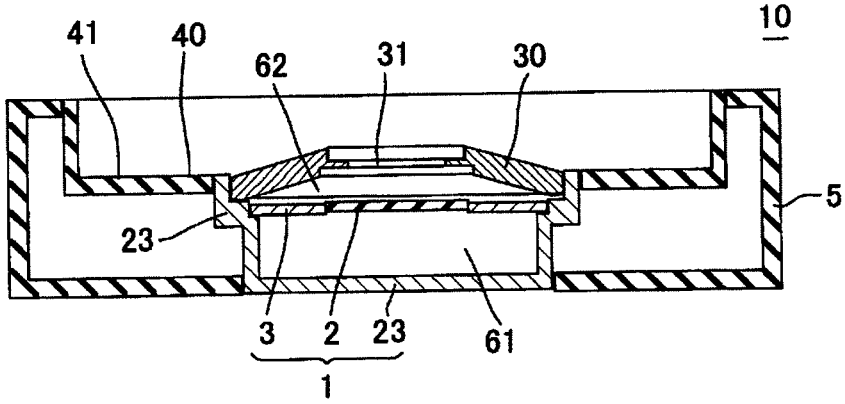
Figure 19C:
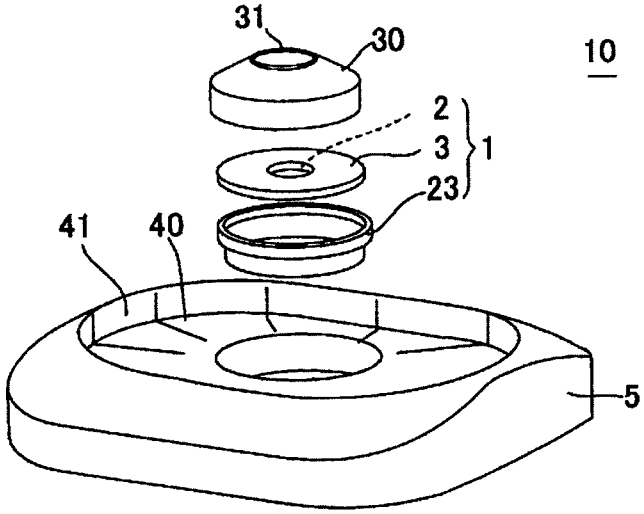
Figure 20:
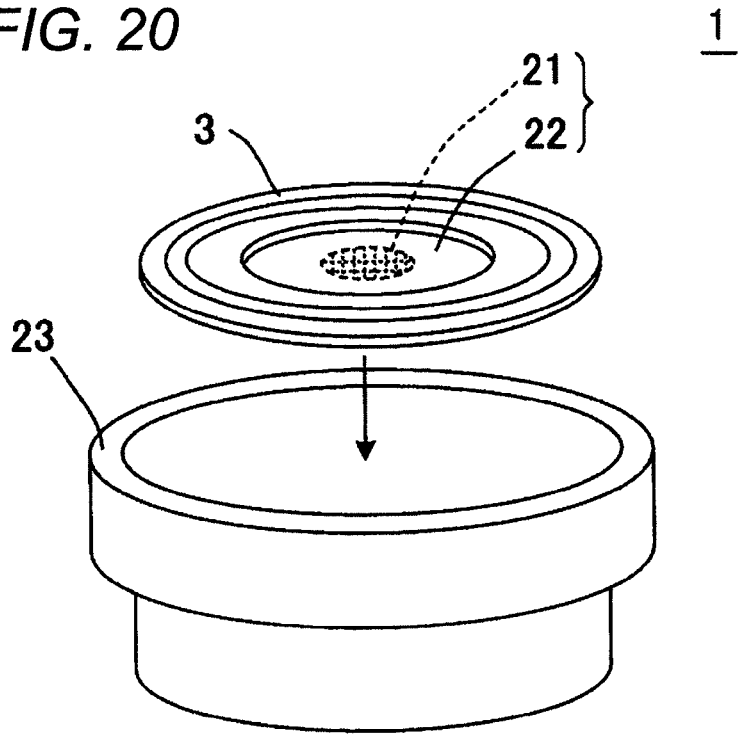
FIG. 20 is a configuration view of a piezoelectric speaker of the piezoelectric audio device.
Figure 21:
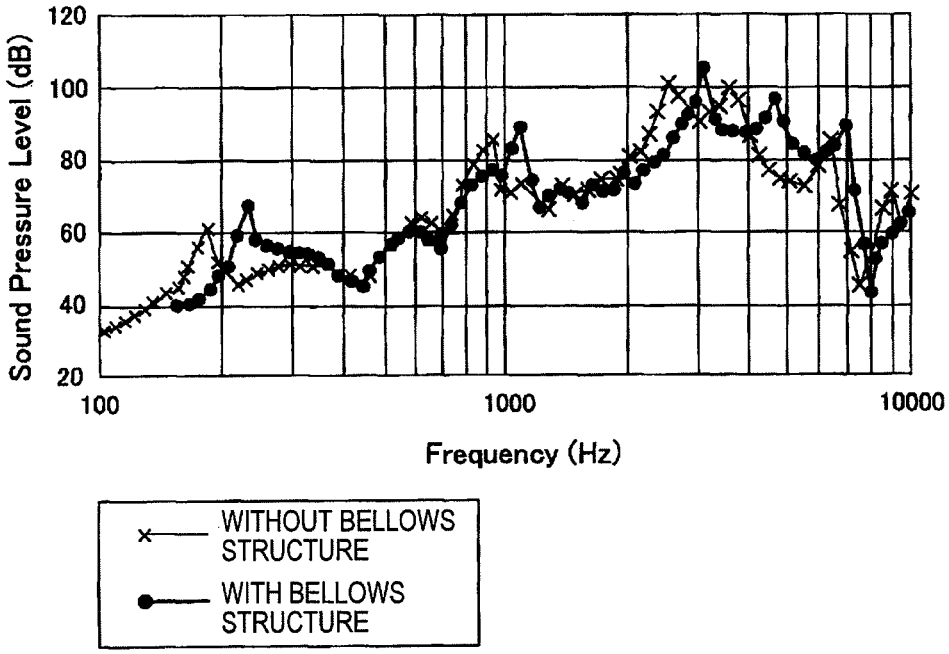
FIG. 21 is a graph showing a variation in a sound pressure level when a film-shaped body of the piezoelectric speaker has a bellows structure and when the film-shaped body does not have a bellows structure.

A piezoelectric audio device 10 according to a sixth embodiment of the invention will be described with reference to FIGS. 19 to 21. A piezoelectric audio device 10 according to the present embodiment includes a piezoelectric speaker 1, a resonator 30 that resonates with a radiation sound emitted by the piezoelectric speaker 1, a reflection plate 40 that reflects the radiation sound toward the front side, and a housing 5 that holds these elements. The piezoelectric speaker 1 includes a piezoelectric vibrator 2, a film-shaped body 3 that is provided around the piezoelectric vibrator 2 so as to hold the piezoelectric vibrator 2, and a frame 23 that supports the outer periphery of the film-shaped body 3. The piezoelectric vibrator 2 includes a piezoelectric body 21 formed of a piezoelectric element and a metal plate used as a plate-shaped body 22 which has a larger diameter than the piezoelectric body 21 and which is concentrically attached to a surface of the piezoelectric body 21. The piezoelectric body 21 is a lead zirconium titanate having a thickness of 0.05 to 0.1 mm, for example. The plate-shaped body 22 is a 42-nickel alloy (an iron-nickel alloy containing 42% of nickel) having a thickness of 0.05 to 0.1 mm, for example. Preferably, the piezoelectric body 21 and the plate-shaped body 22 have the same thickness. The piezoelectric body 21 and the plate-shaped body 22 are attached to each other by an adhesive agent made of an epoxy resin, for example. A silver electrode is formed on the surface of the piezoelectric body 21 and is connected to a lead wire (not shown). When a signal voltage is applied to the electrode, the piezoelectric body 21 is deformed, and the vibration thereof is emitted as sound (vibration of air).

The film-shaped body 3 is a thin member that elastically holds the piezoelectric vibrator 2, and is a resin film such as PEI (polyetherimide) or PEN (polyether naphthalate), having a thickness of 75 to 188 μm, for example. The film-shaped body 3 has a bellows structure which has a doughnut shape, in which the piezoelectric vibrator 2 is attached at the center by an adhesive agent, and which is formed in the circumferential direction. The bellows structure may have a configuration in which a valley portion and a mountain portion are alternately formed as shown in FIGS. 6(*a*) and 6(*b*) of the first embodiment, and the bellows structure may include only the valley portion as shown in FIG. 21C, and may include only the mountain portion as shown in FIG. 21D.

The frame 23 is a bottomed cylindrical body which is formed of a resin, for example, and of which one opening is open. The frame 23 adhesively supports the periphery of the film-shaped body 3 in the flat surface of a step formed on the inner wall of the cylindrical body, and a posterior air chamber 61 is formed between the film-shaped body 3 and the bottom surface. The resonator 30 is cap shaped and has a sound hole 31 at the center. The resonator 30 is provided so as to cover the opening of the frame 23, and an anterior air chamber 62 is formed between the film-shaped body 3 and the resonator 30. The posterior air chamber 61 and the anterior air chamber 62 reflect the radiation sound emitted by the piezoelectric vibrator 2 so as to increase the sound pressure level. The reflection plate 40 has an outer circumference 41 which is erected toward the front side.

A radiation sound emitting operation of the piezoelectric speaker 1 of the piezoelectric audio device 10 according to the present embodiment having the above-described configuration will be described with reference to FIG. 14 described in the third embodiment. FIG. 14 shows the sound pressure level of the piezoelectric speaker 1 when the film-shaped body 3 has the bellows structure and when the film-shaped body 3 does not have the bellows structure. Although the piezoelectric body 21 is contracted and expanded when a signal voltage of a radiation sound is applied to the piezoelectric body 21, since the plate-shaped body 22 to which the piezoelectric body 21 is attached is not contracted and expanded, the piezoelectric vibrator 2 recurves. The piezoelectric vibrator 2 vibrates by repeating this recurving operation and emits a radiation sound. In the film-shaped body 3 having the bellows structure, the film-shaped body 3 is likely to recurve at the position of the bellows structure, and is likely to be expanded and contracted in the circumferential direction when the bellows structure recurves. With this, as shown in FIG. 14, the amplitude of the piezoelectric vibrator 2 increases, and the sound pressure level of the radiation sound emitted by the piezoelectric speaker 1 increases over a low-frequency domain (hereinafter referred to as a low-frequency band) and a high-frequency domain (hereinafter referred to as a high-frequency band).

The resonance frequency of the piezoelectric speaker 1 will be described with reference to FIGS. 9(*a*) to 9C described in the first embodiment. FIG. 9(*a*) shows the cross section of the piezoelectric speaker 1, and FIG. 9(*b*) is a modeling diagram of the piezoelectric speaker 1. In FIG. 9(*a*), the bellows structure of the film-shaped body 3 is not illustrated. As shown in FIG. 9(*b*), the piezoelectric speaker 1 can be regarded as a vibrating structure Q in which a weight G is supported by a support P through a spring J. If the spring constant of the spring J is k, and the mass of the weight G is m, the resonance frequency f of the vibrating structure Q can be expressed by the following expression.

$$f=1/(2\pi)\cdot(k/m)^{1/2}$$

Therefore, if the spring constant of the film-shaped body 3 is $k_0$, and the mass of the piezoelectric vibrator 2 is $m_0$, the resonance frequency $f_0$ of the piezoelectric speaker 1 can be expressed by the following expression.

$$f_0=1/(2\pi)\cdot(k_0/m_0)^{1/2}$$

Moreover, if the Young's modulus of the film-shaped body 3 is E, the thickness of the film-shaped body 3 is h, and the radial length of the film-shaped body 3 is L, the spring constant $k_0$ of the film-shaped body 3 can be expressed by the following expression.

$$k_0=E\cdot h^3/L^2/4$$

Figure 22:
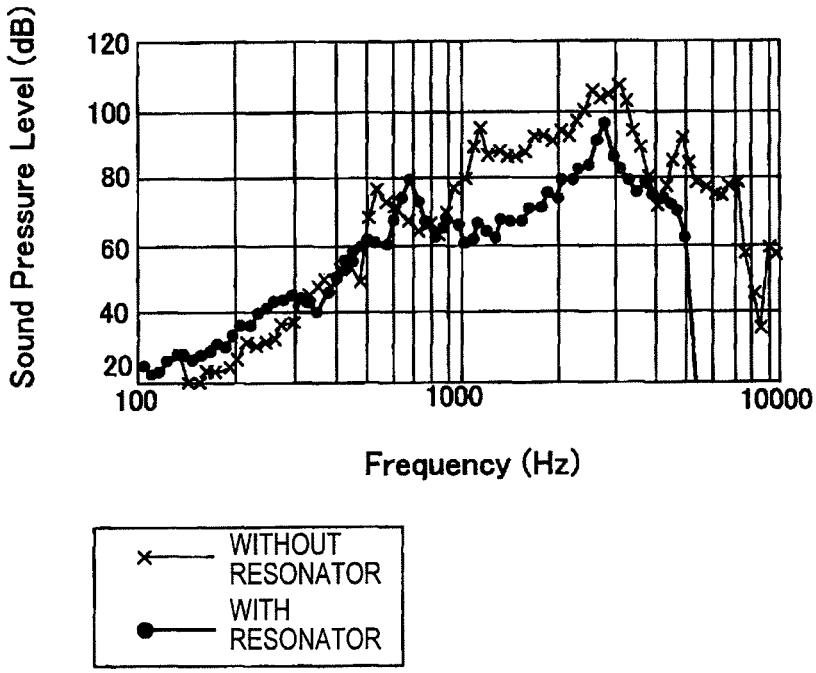
FIG. 22 is a graph showing a variation in a sound pressure level when the piezoelectric audio device has a resonator and when the piezoelectric audio device does not have a resonator.
Figure 23:
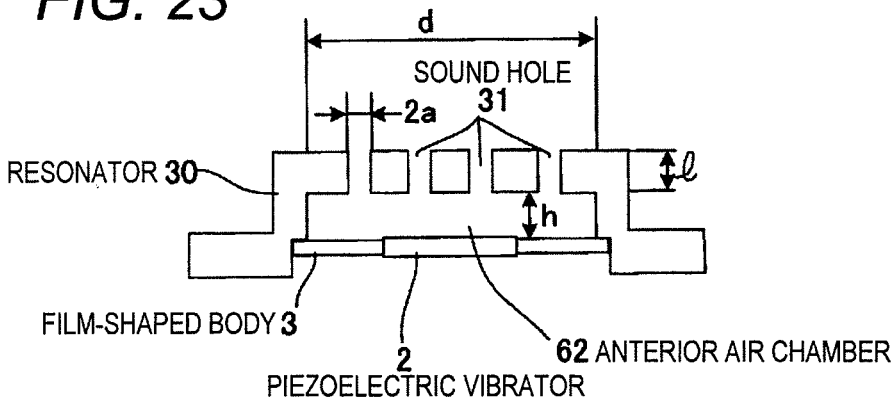
FIG. 23 is a view showing the structure of a resonator of the piezoelectric audio device and a calculation expression of the resonance frequency thereof.

Next, the operation of the piezoelectric audio device 10 of the present embodiment having the configuration described above will be described. FIG. 22 shows the sound pressure level at the respective frequencies of the piezoelectric audio device 10 with and without the resonator 30, and FIG. 23 shows the structure of the resonator 30 and a calculation expression of the resonance frequency thereof. The data regarding the case of 'With Resonator 30' in FIG. 22 are data when the resonator 30 is configured so that the resonance frequency $f_{cav}$ of the anterior air chamber 62 becomes 3000 Hz. If the radius of the air hole is a, the length of the air hole is l, the diameter of the anterior air chamber 62 is d, the height of the anterior air chamber 62 is h, the area of the air hole is S, the volume of the anterior air chamber 62 is V, and the number of air holes n, and the speed of sound is c, the resonance frequency $f_{cav}$ of the anterior air chamber 62 is expressed by the following expression.

$$f_{CAV} = C/2\pi\times(S/V(l+1.3a))^{1/2}$$
$$= C/2\pi\times(4na^2/d^2h(l+1.3a))^{1/2}$$

By changing the configuration of the resonator 30, it is possible to adjust the resonance frequency of the resonator 30. According to the data of FIG. 22, in the case of 'With Resonator 30', the sound pressure level is increased in the range of about 1000 to 4000 Hz as compared to the case of 'Without Resonator 30'. Since the piezoelectric speaker 1 is incorporated into the piezoelectric audio device 10 of the present embodiment, it is possible to obtain a high sound pressure level in the low-frequency band and the high-frequency band. In addition, with such a configuration, the resonator 30 enables the sound pressure level to be increased at any frequency.

First Modification

Hereinafter, various modifications of the present embodiment will be described.

Figure 24A:
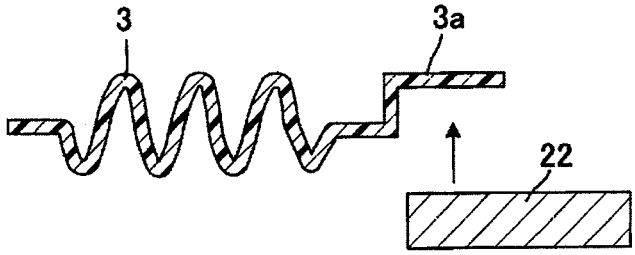
FIGS. 24(*a*) and 24(*b*) are cross-sectional views of a film-shaped body according to a first modification.
Figure 24B:
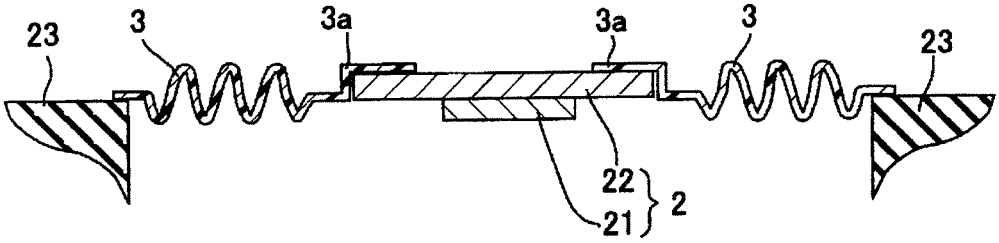

FIGS. 24(*a*) and 24(*b*) show a first modification. In this modification, the film-shaped body 3 has a step-shaped portion 3*a* which is disposed at a position where the piezoelectric vibrator 2 is held. The inner diameter of the step-shaped portion 3*a* has a size such that it engages with the piezoelectric vibrator 2 from the periphery, and the film-shaped body 3 is adhesively attached to the piezoelectric vibrator 2 in a state where the piezoelectric vibrator 2 is engaged. With such a configuration, the piezoelectric vibrator 2 is reliably attached to the film-shaped body 3, and the attachment position becomes constant. Thus, the sound pressure level and the resonance frequency of the radiation sound emitted by the piezoelectric speaker 1 are stabilized.

Second Modification

Figure 25:
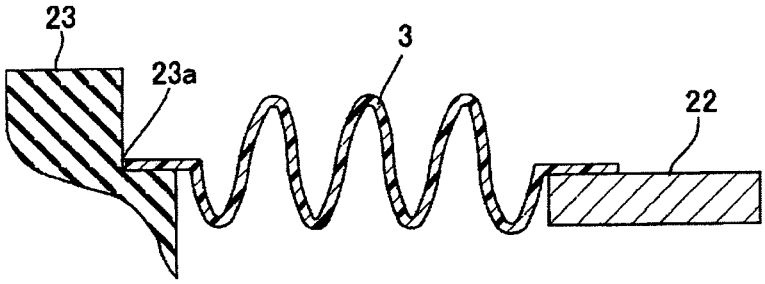
FIG. 25 is a cross-sectional view of a film-shaped body and a frame according to a second modification.

FIG. 25 shows a second modification. In this modification, the frame 23 has an L-shaped portion 23*a* in a cross-sectional view thereof which is disposed at a position where the film-shaped body 3 is supported. The L-shaped portion 23*a* has an L-shape on the vertical cross section, and the film-shaped body 3 is placed on that portion so as to be engaged and supported. The inner diameter of the vertical portion of the L-shape has a size such that it engages with the film-shaped body 3 from the periphery, and the frame 23 is adhesively attached to the film-shaped body 3 in a state where the film-shaped body 3 is engaged. With such a configuration, the film-shaped body 3 is reliably attached to the frame 23, and the attachment position becomes constant. Thus, the sound pressure level and the resonance frequency of the radiation sound emitted by the piezoelectric speaker 1 are stabilized.

Third Modification

Figure 26A:
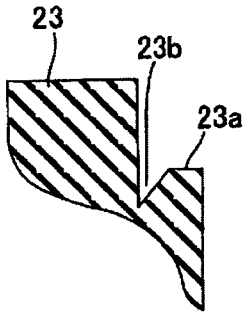
FIGS. 26(*a*) to 26(*c*) are views showing a third modification, in which FIG. 26(*a*) is a partial cross-sectional view of a frame of the modification, FIG. 26(*b*) is a cross-sectional view when an adhesive agent is being filled in the frame, and FIG. 26(*c*) is a plan view when an adhesive agent has been filled in the frame.
Figure 26B:
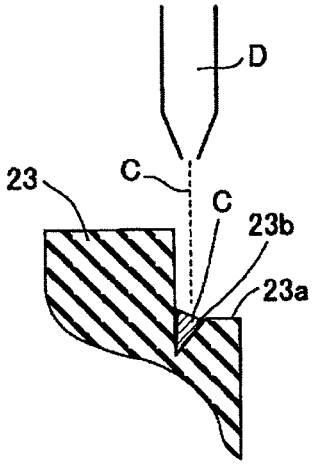
Figure 26C:
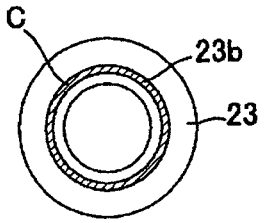

FIGS. 26(*a*) to 26(*c*) show a third modification. In this modification, in addition to the configuration of the second modification, the frame 23 further includes a notch 23*b* that is formed on a surface on which the L-shaped film-shaped body 3 is placed, and an adhesive agent C is filled into the notch 23*b* using a dispenser D. The applied adhesive agent C is deposited into the notch 23*b*, and the film-shaped body 3 can be adhesively attached without floating. Thus, the film-shaped body 3 is reliably attached to the frame 23, and the sound pressure level and the resonance frequency of the radiation sound emitted by the piezoelectric speaker 1 are stabilized.

Fourth Modification

Figure 27A:
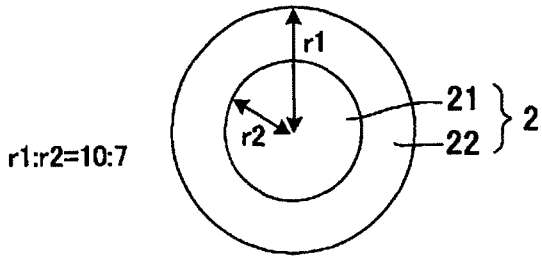
FIGS. 27(*a*) and 27(*b*) are views showing a fourth modification, in which FIG. 27(*a*) is a configuration view of a piezoelectric vibrator according to the modification, and FIG. 27(*b*) is a graph showing a variation in the resonance frequency when the diameter of a piezoelectric body is changed.
Figure 27B:
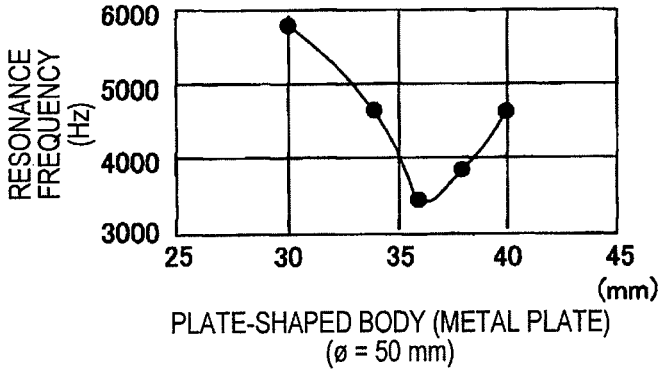

FIG. 27(*a*) shows a fourth modification. In this modification, the plate-shaped body 22 and the piezoelectric body 21 have an approximately disc shape, and the ratio of the radius of the plate-shaped body 22 to that of the piezoelectric body 21 is set to approximately 10:7. FIG. 27(*b*) shows a change in the resonance frequency when the diameter of the piezoelectric body 21 is changed with the diameter of the plate-shaped body 22 maintained to be constant. The piezoelectric body 21 and the plate-shaped body 22 are circular, and the diameter of the plate-shaped body 22 is 50 mm. The resonance frequency is the lowest when the diameter of the piezoelectric body 21 is near 35 mm, and in this case, the ratio of the radius of the plate-shaped body 22 to that of the piezoelectric body 21 is about 10:7. The ratio of the radius of the plate-shaped body 22 to that of the piezoelectric body 21 is preferably between 10:6 and 10:8. Therefore, since the resonance frequency of the piezoelectric speaker 1 decreases when the configuration of this modification is used, it is possible to increase the sound pressure level at a low-frequency band.

Fifth Modification

Figure 28:
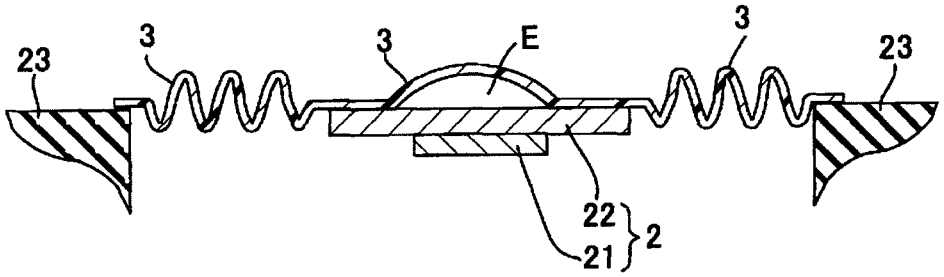
FIG. 28 is a cross-sectional view of a piezoelectric speaker according to a fifth modification.

FIG. 28 shows a fifth modification. In this modification, the film-shaped body 3 covers the piezoelectric vibrator 2, and an air layer E is provided between the film-shaped body 3 and the piezoelectric vibrator 2. The acoustic impedance of air is far lower than the acoustic impedance of the plate-shaped body 22. Thus, by forming the film-shaped body 3 so as to form the air layer E on the entire surface of the piezoelectric vibrator 2, it is possible to decrease the acoustic impedance of the plate-shaped body 22. With this configuration, since the radiation sound emitted by the piezoelectric vibrator 2 can be transmitted toward the front side without attenuation, it is possible to increase the sound pressure level. Moreover, it is possible to suppress the occurrence of dips wherein the sound pressure level decreases abruptly at a specific frequency.

Sixth Modification

Figure 29A:
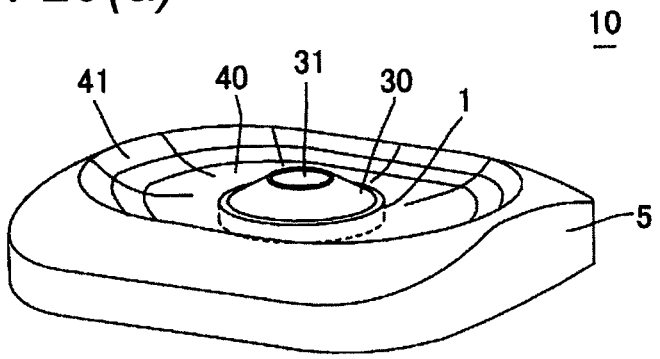
FIGS. 29(*a*) and 29(*b*) are views showing a sixth modification, in which FIG. 29(*a*) is a configuration view of a piezoelectric audio device according to the modification, and FIG. 29(*b*) is a cross-sectional view of the piezoelectric audio device.
Figure 29B:
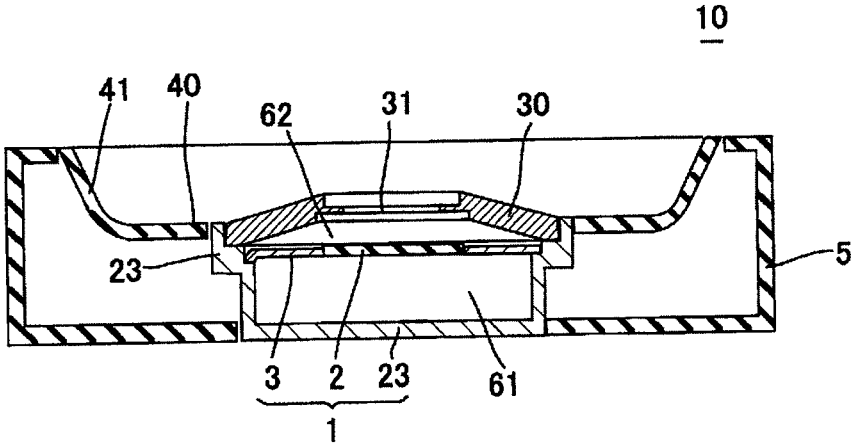

FIGS. 29(*a*) and 29(*b*) show a sixth modification. In this modification, the outer circumference 41 of the reflection plate 40 has a shape such that it is erected toward the front side with an approximately exponential curve. In the exponential curve portion, the radiation sound is not likely to resonate. In general, when the reflection plate 40 has an approximately rectangular shape or an approximately elliptical shape, the directivity of the radiation sound is different in the longitudinal direction and the lateral direction of the reflection plate 40. However, as in the above-described configuration, when the outer circumference 41 of the reflection plate 40 has an approximately exponential curve, the radiation sound is not likely to resonate in the outer circumference. Thus, it is possible to decrease the difference in the directivity of the radiation sound in the longitudinal direction and the lateral direction of the reflection plate 40. In this case, the difference in the directivity of the radiation sound can be further decreased when the air hole 31 of the resonator 30 is formed between the opening position of the frame 23 and the upper end position of the outer circumference of the reflection plate 40 in the front-to-rear direction of the piezoelectric audio device 10.

Seventh Modification

Figure 30A:
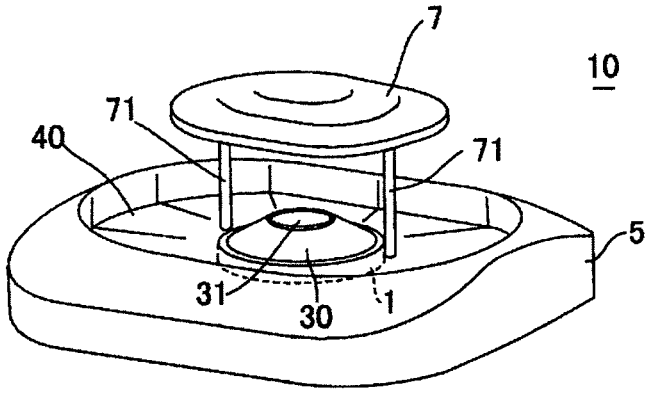
FIGS. 30(*a*) and 30(*b*) are views showing a seventh modification, in which FIG. 30(*a*) is a configuration view of a piezoelectric audio device according to the modification, and FIG. 30(*b*) is a cross-sectional view of the piezoelectric audio device.
Figure 30B:
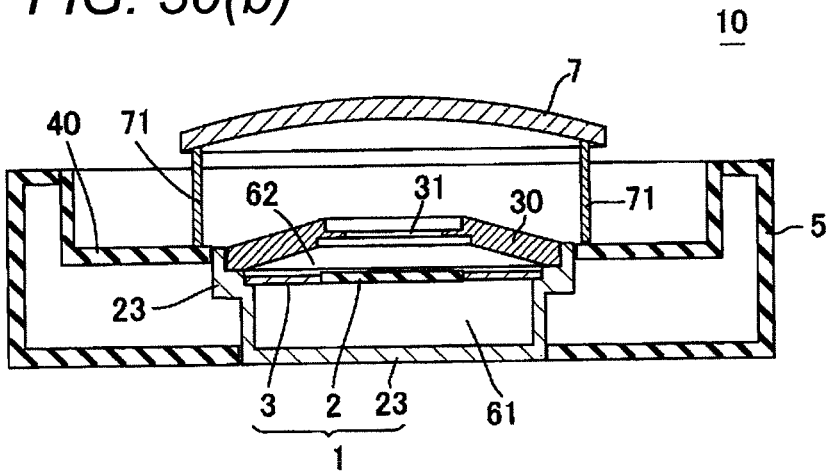
Figure 31:
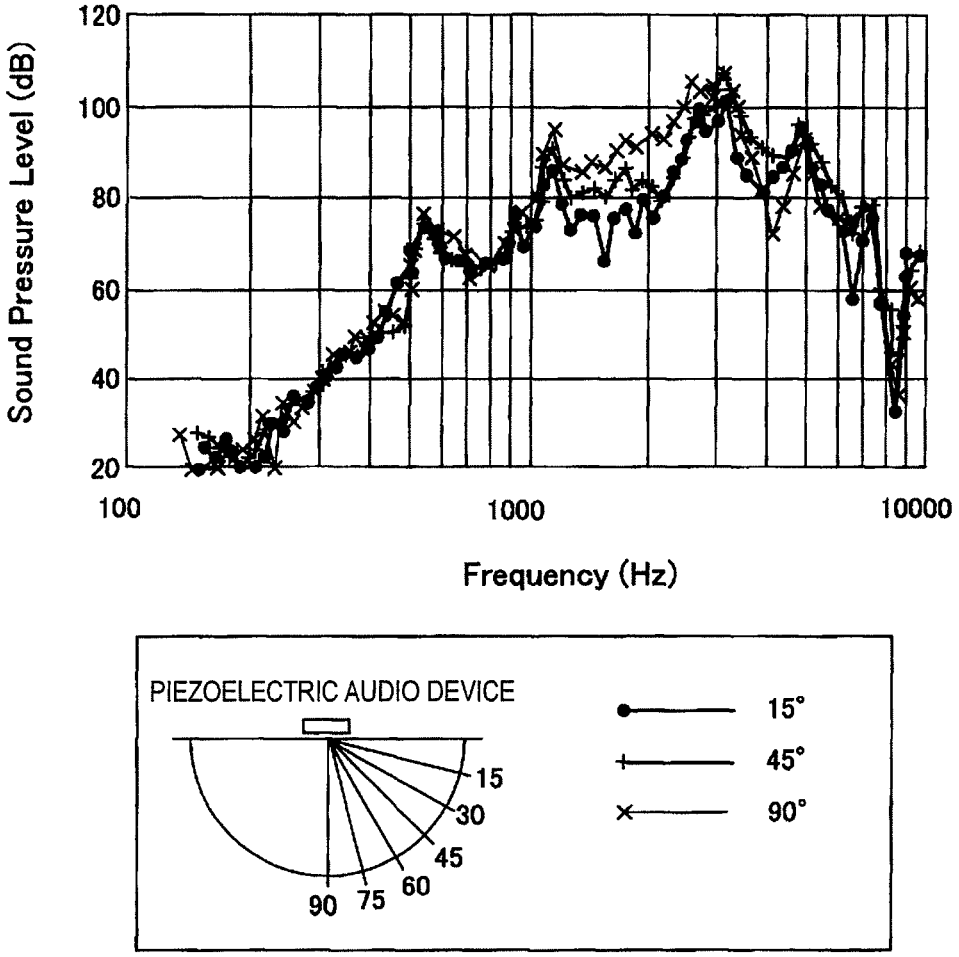
FIG. 31 is a graph showing directivity of a radiation sound in the piezoelectric audio device.

FIGS. 30(*a*) and 30(*b*) show a seventh modification. In this modification, the piezoelectric audio device 10 includes a plate-shaped horn cap 7 that is provided on the front side of the resonator 30 so as to adjust the directivity of the radiation sound. The horn cap 7 is bent toward the resonator 30 and is supported by columnar supports 71 that are formed on the reflection plate 40. FIG. 31 shows the directivity of the radiation sound when the horn cap 7 is attached. The sound pressure levels in directions of 15°, 45°, and 90° are shown wherein the front direction of the piezoelectric audio device 10 is 90°, and the direction vertical to the front direction is 0°. In this way, since the transmission direction of the radiation sound is widened when the horn cap 7 is attached, the difference in the sound pressure levels in the directions of 15° and 90° decreases. Thus, it is possible to flatten the directivity. In addition, the directivity can be changed by changing the length of the columnar supports 71. The directivity is flattened when the length is decreased, and the directivity is sharpened when the length is increased.

Eighth Modification

Figure 32:
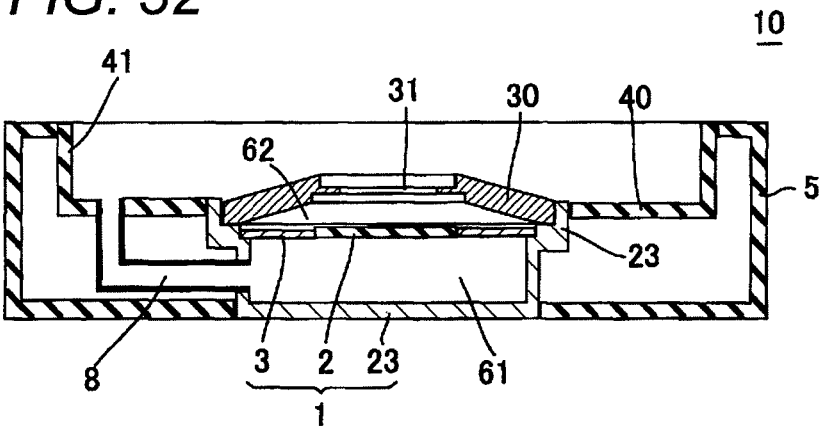
FIG. 32 is a cross-sectional view of a piezoelectric audio device according to an eighth modification.

FIG. 32 shows an eighth modification. In this modification, the piezoelectric audio device 10 includes a duct 8 that connects the front space of the reflection plate 40 and the posterior air chamber 61, and the resonance frequency of the piezoelectric audio device 10 is adjusted by the duct 8. The duct 8 is provided so as to extend from a side surface of the cylindrical body of the frame 23 to the bottom surface of the reflection plate 40, and a plurality of ducts 8 may be formed. The duct 8 releases the radiation sound reflected by the posterior air chamber 61 toward the front side of the reflection plate 40. By changing the cross-sectional area and the length of the duct 8, it is possible to change the resonance frequency of the duct 8. If the cross-sectional area of the duct 8 is D, the length of the duct is L, the volume of the posterior air chamber 61 is $V_c$, and $r=(D/\pi)^{1/2}$, the resonance frequency $f_d$ of the duct 8 is expressed by the following expression.

$$f_d=160(D/V_c/(L+r)^{1/2}$$

Figure 33:
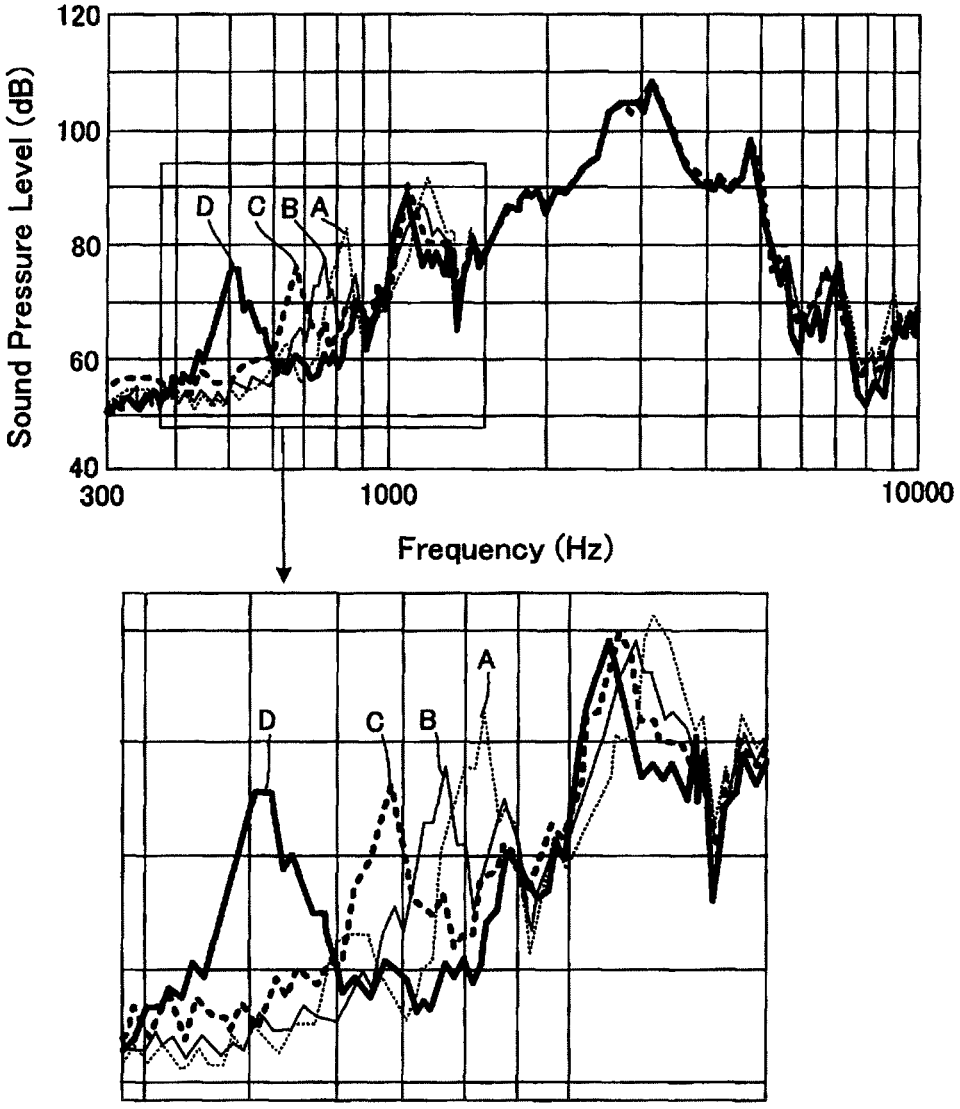
FIG. 33 is a graph showing a variation in a sound pressure level when the piezoelectric audio device has a duct, and when the piezoelectric audio device does not have a duct.

FIG. 33 shows examples of the sound pressure level of the piezoelectric audio device 10 with and without the duct 8, and a part of the graph is shown in an enlarged view. Three data in which the duct 8 has different cross-sectional areas are shown for the case of 'With Duct 8'. Since the shape of the duct 8 is limited by the shape of the piezoelectric audio device 10, and an overall shape thereof is determined, the resonance frequency of the duct 8 is mainly in the low-frequency band. In the example of FIG. 33, the sound pressure level in the low-frequency band increases. Moreover, the peak frequency of the sound pressure level is different depending on the size of the cross-sectional area of the duct 8. The peak frequency moves toward the high-frequency band as the cross-sectional area increases. By configuring the piezoelectric audio device 10 in such a way, it is possible to create the resonance frequency in the low-frequency band. Thus, it is possible to change the peak frequency of the sound pressure level in the low-frequency band.

Ninth Modification

Figure 34:
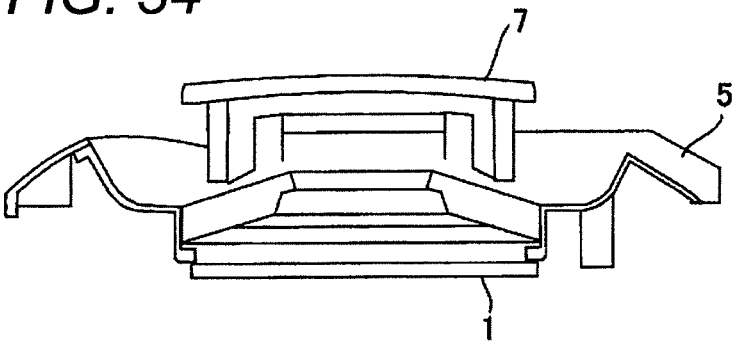
FIG. 34 is a cross-sectional view of a piezoelectric audio device according to a ninth modification.
Figure 35:
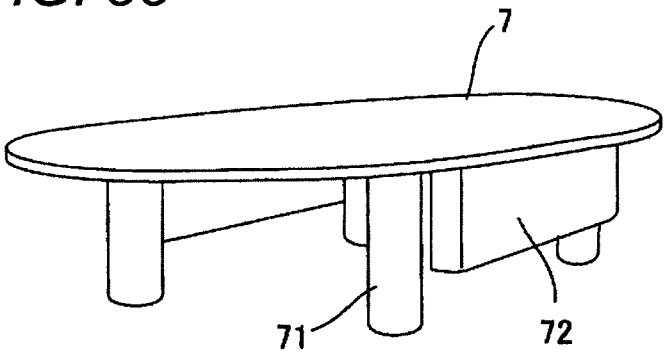
FIG. 35 is a perspective view of a duct of a piezoelectric audio device according to the ninth modification.

FIGS. 34 and 35 show a ninth modification. In this modification, as shown in FIGS. 30(*a*) and 30(*b*), the piezoelectric audio device 10 has the horn cap 7 similarly to the piezoelectric audio device of the seventh modification, and the propagation direction of the sound from the piezoelectric audio device 10 is adjusted by the horn cap. In this modification, a partition formed of a flat plate 72 is disposed on the rear side of the horn cap. The presence of the flat plate 72 suppresses the propagation in the vertical direction, namely in the ceiling-to-floor direction so as to be converted into a propagation in the horizontal direction. Reference numeral 5 is the housing, and reference numeral 2 is the piezoelectric vibrator.

Figure 36:
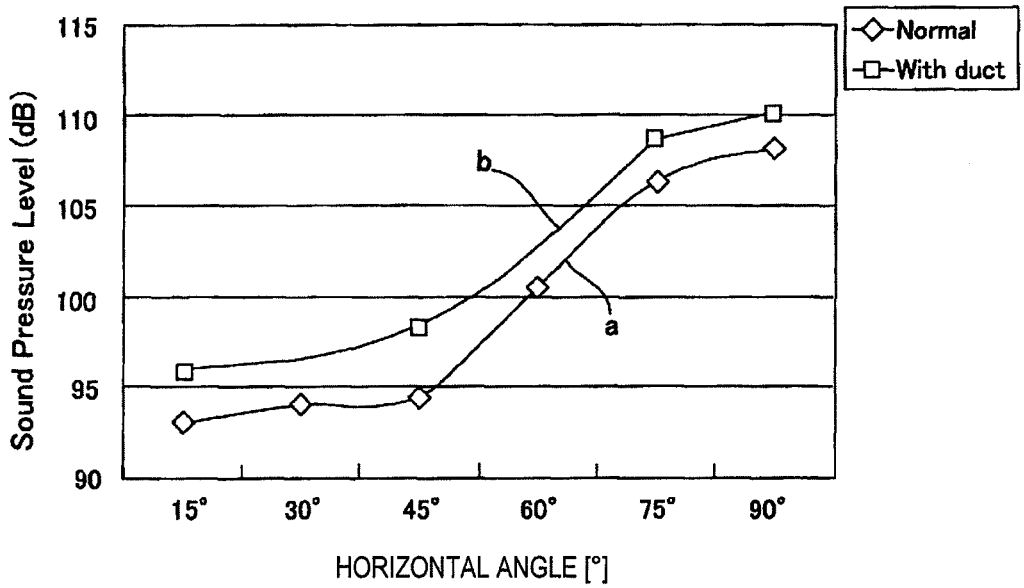
FIG. 36 is a graph showing a variation in a sound pressure level when the piezoelectric audio device has a duct, and when the piezoelectric audio device does not have a duct.

FIG. 36 shows examples of the sound pressure level of the piezoelectric audio device 10 when the horn cap 7 has the flat plate 72 and when the horn cap 7 does not have the flat plate 72. When the horn cap 7 has the flat plate 72, as depicted by curve 'a', the sound pressure level in directions having an angle is decreased as compared to curve 'b' for the case when the horn cap does not have the flat plate. That is, the propagation rate in the horizontal direction is increased by that amount. Accordingly, this modification is ideal for products which are installed on a wall.

The invention is not limited to the configurations of the above-described various embodiments, but various modifications can be made without departing from the spirit of the invention. For example, in the embodiments described above, although the film-shaped body 3 is provided on the entire periphery of the piezoelectric vibrator 2 so as to hold the piezoelectric vibrator 2, the film-shaped body 3 may be provided on a part of the periphery of the piezoelectric vibrator 2.

In any of the embodiments described hereinabove, a resin film, paper made of wood pulp, paper made of non-wood plant such as paper mulberry, paper bush, or bamboo, a nonwoven fabric, a material in which an adhesive agent is impregnated into a nonwoven fabric so as to enhance rigidity, a material in which urethane is coated on polyester, titanium, aluminum, and the like may be used as the film-shaped body.

Moreover, the thickness of the film-shaped body is not particularly limited, and the thickness and the material thereof are preferably selected from the perspective of using a membrane that is easy to vibrate.

This application is based upon and claims the benefit of priority from Japanese Patent Applications filed on Dec. 26, 2008 (Application Nos. 2008-334854 and 2008-334872) and Japanese Patent Application filed on Oct. 27, 2009 (Application No. 2009-246392), the entire contents of which are incorporated herein by reference.

DESCRIPTION OF REFERENCE SIGNS

1: Piezoelectric Speaker
2: Piezoelectric Vibrator
3: Film-Shaped Body (Resonator)
3M: Mountain Portion
3V: Valley Portion
3F: Antinodes
3D: Doping Region
4: Frame
5: Housing
7: Horn Cap
8: Duct
10: Piezoelectric Audio Device
21: Piezoelectric Body
22: Plate-Shaped Body
23: Frame
31: Sound Hole
40: Reflection Plate
41: Outer Circumference
50: Elastic Body
61: Posterior Air Chamber
62: Anterior Air Chamber
72: Flat Plate
103: Body
102: Optical Smoke Detector
104: Rear Cover
105: Base
106: Battery
101: Cover
H: Hole

The invention claimed is:

1. A piezoelectric speaker comprising:
a piezoelectric vibrator comprising:
a piezoelectric body formed of a piezoelectric element; and
a plate-shaped body which has a larger diameter than the piezoelectric body and which is attached to a surface of the piezoelectric body in a concentric form; and
a film-shaped body that has a bellows structure which is provided around the piezoelectric vibrator so as to elastically hold the piezoelectric vibrator,
wherein the piezoelectric vibrator has at least one of a mountain portion and a valley portion in the circumferential direction thereof,
wherein an antinode of the bellows structure is identical to an apex of an antinode of a vibration mode which is an in-phase mode of a natural frequency corresponding to a disposition of the film-shaped body, and
wherein the piezoelectric vibrator and the film-shaped body form a sound producing body.

2. The piezoelectric speaker according to claim 1,
wherein no bellows (a mountain portion and a valley portion) is present at a position of the node of the vibration mode.

3. The piezoelectric speaker according to claim 1,
wherein in the bellows structure of the film-shaped body, the bellows and the antinodes of the vibration mode correspond to each other in a one-to-one correspondence, and the apex of the antinode of the bellows is identical to the apex of the antinode of the vibration mode.

4. The piezoelectric speaker according to claim 1,
wherein the natural frequency is a resonance point between 2 kHz and 4 kHz.

5. The piezoelectric speaker according to claim 1,
wherein an edge of the film-shaped body is held by an elastic body.

6. The piezoelectric speaker according to claim 5,
wherein the elastic body comprises polyurethane foam or thermoplastic elastomer.

7. The piezoelectric speaker according to claim 1,
wherein the plate-shaped body comprises a metal plate.

8. The piezoelectric speaker according to claim 7,
wherein the metal plate and the piezoelectric body have an approximately disc shape, and
wherein a ratio of a radius of the metal plate to that of the piezoelectric body is 10:4.

9. The piezoelectric speaker according to claim 1,
wherein the film-shaped body may be a resin film.

10. A sensor with an alert device attached, comprising:
the piezoelectric speaker according to claim 1;
a sensor element configured to detect an event; and
a driver configured to drive the piezoelectric speaker in accordance with an output of the sensor element.

* * * * *